US006281839B1

(12) United States Patent
Nielsen

(10) Patent No.: US 6,281,839 B1
(45) Date of Patent: Aug. 28, 2001

(54) METHOD AND SYSTEM FOR COMMUNICATING ELECTROMAGNETIC SIGNALS

(76) Inventor: Peter Nielsen, Skivevej 83, DK-9500 Hobro (DK)

( * ) Notice: Subject to any disclaimer, the term of this patent is extended or adjusted under 35 U.S.C. 154(b) by 0 days.

(21) Appl. No.: 09/051,582

(22) PCT Filed: Oct. 11, 1996

(86) PCT No.: PCT/DK96/00434

§ 371 Date: Apr. 13, 1998

§ 102(e) Date: Apr. 13, 1998

(87) PCT Pub. No.: WO97/15092

PCT Pub. Date: Apr. 24, 1997

(30) Foreign Application Priority Data

Oct. 13, 1995 (DK) ..... 1158/95
Jan. 11, 1996 (DK) ..... 0021/96

(51) Int. Cl.[7] ..... H01Q 3/26; H01Q 3/02; H01Q 3/12

(52) U.S. Cl. ..... 342/372; 342/374; 342/422

(58) Field of Search ..... 342/359, 368, 342/371, 372, 374, 369, 370, 373, 375, 376, 377, 422, 367; 343/757

(56) References Cited

U.S. PATENT DOCUMENTS

| | | | | |
|---|---|---|---|---|
| Re. 28,546 | * | 9/1975 | Foldes | 342/361 |
| 4,135,193 | * | 1/1979 | Kommrusch | 342/374 |
| 4,451,699 | * | 5/1984 | Gruenberg | 342/370 |
| 4,881,078 | | 11/1989 | Yamane et al. . | |
| 5,151,706 | * | 9/1992 | Roederer et al. | 342/372 |
| 5,485,170 | * | 1/1996 | McCarrick | 343/895 |

FOREIGN PATENT DOCUMENTS

| | | |
|---|---|---|
| 0452970A2 | 10/1991 | (EP) . |
| 2253520A | 9/1992 | (GB) . |
| 2291755A | 1/1996 | (GB) . |
| 2295493A | 5/1996 | (GB) . |

OTHER PUBLICATIONS

The performance enhancement of multibeam adaptive base–station antennas for cellular land mobile radio systems, Swales, S.C.; Beach, M.A.; Edwards, D.J.; McGeehan, J.P., Vehicular Technology, IEEE Transactions on, vol. 39 Issue: 1, Feb. 1990, pp. 56–67.*

(List continued on next page.)

*Primary Examiner*—Thomas H. Tarcza
*Assistant Examiner*—Fred H. Mull

(57) ABSTRACT

A method for two way communication between a first station and a second station each said station comprising receiving means and transmitting means for receiving and transmitting electromagnetic communication signals, whereby one or more signals are transmitted from the first station to the second station, and the direction of the physical boresight axis of the antenna of the first station is controlled, said controlling comprising electrically changing or switching the direction of optimum reception or electric boresight of reception of the antenna of the first station in one or more directions displaced from the direction of the physical boresight axis by changing electric characteristics of said feeding means, monitoring, during said switching of the direction of optimum reception or electric boresight of reception, one or more signals carrying information representing variations in receiving signal strength of one or more signals transmitted from the second station and received by the first station during said switching, and mechanically moving the antenna in response to the results of said monitoring of the signal strength information signal(s) thereby changing the direction of the physical boresight axis so as to reduce or minimize pointing errors of the antenna in relation to the second station and increase or maximize the strength of signals received by the first station from the second station and/or vice versa.

60 Claims, 18 Drawing Sheets

OTHER PUBLICATIONS

Figure 1A:
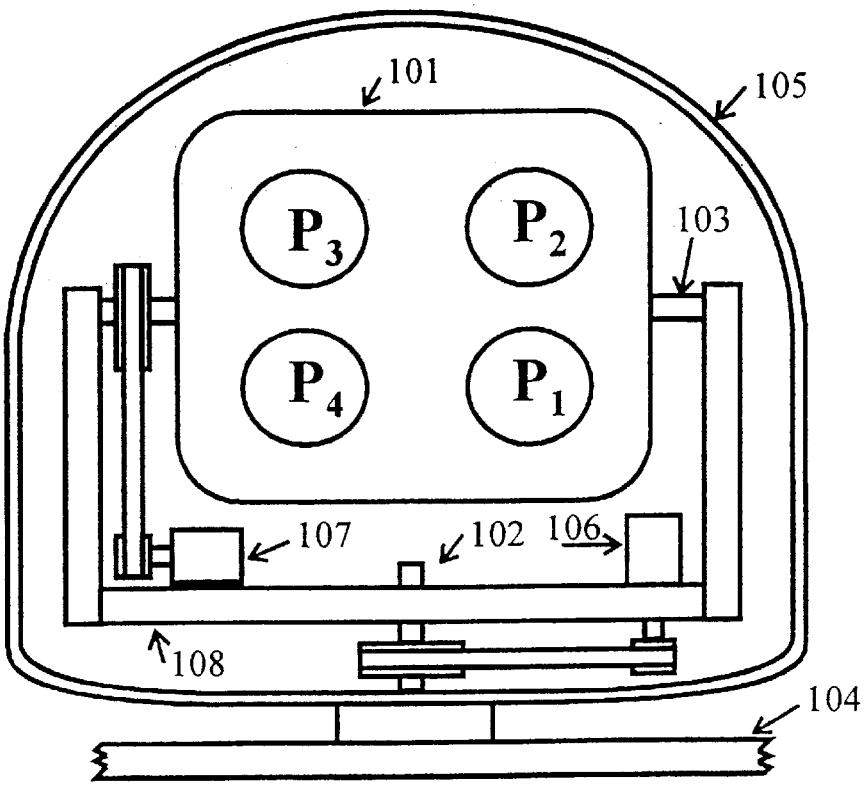

Spectrally efficient techniques for MSS systems operating between 1525–1530/1626.5–1660.5 MHz, Brown–Kenyon, P., IEE Colloquium on Spectrally Efficient Techniques for Satellite Communications, 1994, pp. 311–313.*

37$^{th}$ IEEE Vehicular Technology Conference—XP 002008503—L–Band Phased Array Antennas for Mobile Satellite Communications—John Huang.

Nippon Telegraph and Telephone Corp. Electrical Communications Laboratories—XP 002008504—Compact Mobile Antennas for Mobile Satellite Communications—N. Terada, K. Satoh, and F. Yamazaki.

* cited by examiner

METHOD AND SYSTEM FOR COMMUNICATING ELECTROMAGNETIC SIGNALS

This application is the national phase under 35 U.S.C. §371 of prior PCT International Application No. PCT/DK96/00434 which has an International filing date of Oct. 11, 1996 which designated the United States of America, the entire contents of which are hereby incorporated by reference.

The present invention relates to a method and a system for communicating electromagnetic signals, and more particularly to a method and a system for stabilizing an antenna for tracking an electromagnetic energy source. The invention also relates to a communication method and system for simultaneously receiving and transmitting signals.

In communication via a satellite to and from a moving vehicle such as a ship or car, a mobile terminal installed on the vehicle is required. Usually mobile INMARSAT terminals are composed of one part being installed on a vehicles platform which platform is in a fixed position relative to the vehicle. This platform will hereafter be designated "moving platform" and the part of the terminal that is installed on it is designated EME (external mount equipment). Furthermore, the terminal may comprise electronics that is installed in the wheelhouse of the vehicle. This part of the terminal is designated IME (internal mount equipment).

There is a well-known problem associated with stabilization of the antenna of the EME in such a way that specifications for G/T (Antenna Gain/Receive system noise Temperature) for the receiving system in the direction of the satellite as well as EIRP (Equivalent Isotropic Radiated Power) for the transmit system are met, as long as vehicle motions such as pitch, roll and turn rate are within specified limits. This stabilization problem becomes more serious when the gain of the applied antenna in the mobile terminal gets higher. Because of adoption of new modulation techniques and launching of satellites having a much higher EIRP and G/T at the L-band, it has become possible to reduce the antenna gain and hence the size and cost of the EME. This invention shall be seen in the light of this ongoing process of reducing cost, size and complexity of EME.

Up till now at least three types of mobile terminals employing a stabilized-antenna are defined by INMARSAT, namely INMARSAT A, INMARSAT B and INMARSAT M. Antenna stabilization is typically performed by one of two methods namely, 1) the so-called passive stabilization or 2) the socalled active stabilization, the former being the most simple and the latter being the solution showing the best performance. However, with the reduction of size and weight for future terminals, method 2) should bring the best solution since fly-wheels with high momentum of inertia become increasingly difficult to accommodate in the structure of an electromechanical antenna stabilizing system. In INMARSAT A, B and M, many different types of stabilization mechanisms have been used with the number of rotation axes ranging from two to four. Within the field of antenna stabilization it has been common practice to use gravity as a reference to measure inclination of the moving platform and to use either the magnetic field of the earth or the information from a gyro (e.g. ships' gyro) as a azimuth reference. With these two references it is possible to generate a set of control signals to be fed to the various motors that control angular rotation about the mechanical axes. Generation of a vertical reference can be done by an inclinometer that is made insensitive to horizontal accelerations. However, the azimuth reference usually present a problem since the magnetic field of the earth is affected by the structure of the vehicle and since the inclination may be high, i.e. close to 90°, so that a precise projection onto a plane parallel to the surface of the earth becomes increasingly difficult to achieve. On the other hand, a reference from a gyro is very reliable but requires the vehicle to be equipped with an expensive apparatus. Also, installation of the terminal is complicated by the need to interface to a gyro or other exterior devices.

A system using active stabilization, method 2, is described in U.S. Pat. No. 4,881,078. This patent discloses a tracking system with a beam switching antenna. The tracking system is used for tracking a stationary satellite, and a phased array is used for an antenna mounted on an automobile. The phased array antenna has a sharp beam which is switched between two different directions in azimuth. The antenna beam is switched between the two directions periodically by control of phase constants in a feeding circuit of the antenna and comparison is made in strength between signals received before and after the beam switching to obtain an error signal as an azimuth error signal. Then, the antenna is mechanically moved according to the error signal until the error signal becomes zero.

However, the tracking system of U.S. Pat. No. 4,881,078 only comprises a receiver system. Hence, there is a need to have a combined receiver and transmitting system using active stabilization for tracking an electromagnetic energy source such as a communication satellite or a repeater satellite.

In communication systems utilizing phase modulation (such as the new INMARSAT systems) there is, however, a serious problem associated with beam switching in that the phase of the transmit signal and hence the transmit frequency spectrum may be disturbed by the beam switching when this is performed on transmit frequencies as well as receive frequencies as is the case in conventional beam switch systems utilizing phase shifters located in the signal path common to both receive and transmit signals coming from and going to the antenna elements in e.g. a phased array.

Another disadvantage of conventional beam switching is that there is a typical 0.4 dB loss of transmit power due to the fact that the direction of maximum transmission is switched a few degrees from physical bore sight of the antenna. Furthermore in conventional systems, considerable loss of transmit power may occur in the switching diodes of the phase shifters. The switching diodes must therefor be bulky which in turn leads to higher parasitic components such as parallel capacitance and series inductance. This in turn makes it difficult to match the antenna and duplexer to the low noise amplifier (LNA) so that the noise figure may be increased and even worse, the varying LNA gain and noise figure may vary when switching diodes are turned on and off. In tracking systems based on beam switching, LNA gain and noise FIG. must be kept absolutely constant to ensure good tracking performance.

Thus, it is an object of the present invention to bring a solution to the above mentioned problem. Accordingly, the present invention provides a method and a system for two way communication between a first station and a second station where each of the stations comprises a receiving means and transmitting means for receiving and transmitting electromagnetic communication signals. The first station has an array antenna for transmitting and receiving the electromagnetic communication signals to and from the second station, and the array antenna has a direction of optimum transmission or direction of electric boresight of transmission which is substantially constant in relation to a physical boresight axis of the antenna or an axis perpendicular to a plane mainly comprising the array antenna. The array antenna is coupled to the receiving means and transmitting means of the first station by electrical feeding means.

In the method according to the invention one or more signals is/are transmitted from the first station to the second station, and the direction of the physical boresight axis of the antenna of the first station is controlled so as to reduce or minimize pointing errors of the antenna in relation to the second station. In order to obtain signals for controlling the physical boresight axis of the antenna, the direction of optimum reception or electric boresight of reception of the antenna of the first station is electrically changed or switched in one or more directions displaced from the direction of the physical boresight axis by changing electric characteristics of the feeding device. During the electrically switching of the direction of optimum reception or electric boresight of reception, one or more signals carrying information representing variations in receiving signal strength of one or more signals transmitted from the second station and received by the first station during said switching is/are being monitored.

The results of the monitoring may be used as control signals, and preferably, the antenna is mechanically and/or angularly moved in response to the results of said monitoring of the signal strength information signal(s) whereby the direction of the physical boresight axis is changed so as to reduce or minimize pointing errors of the antenna in relation to the second station. Hence, the strength of signals received by the first station from the second station and/or vice versa should be increased.

In the communication system according to the invention the first station further has a switching device for electrically changing or switching the direction of optimum reception or electric boresight of reception of the antenna of the first station in one or more directions displaced from the direction of the physical boresight axis by changing electric characteristics of the feeding device.

The first station also includes a monitoring device for monitoring, during the electrical switching of the direction of optimum reception or electric boresight of reception, one or more signals carrying information representing variations in receiving signal strength of one or more signals transmitted from the second station and received by the first station during said switching.

In order to control the direction of the physical boresight axis of the antenna of the first station so as to reduce or minimize pointing errors of the antenna in relation to the second station, the first station should also have a moving device for mechanically and/or angularly moving the antenna, and a control device for controlling the movement of the antenna in response to the results of monitoring of the signal strength information signal(s). The antenna should be moved so as to change the direction of the physical boresight axis in order to reduce or minimize pointing errors of the antenna in relation to the second station.

It is also an object of the invention to provide a tracking system for tracking an electromagnetic energy source, such as a second station, where the tracking system has a first station similar to the first station of the communication system.

In the above discussion references are made to electrical and physical boresigth directions of the antenna. Here it should be noticed that in the present context the physical boresight axis of the array antenna represents the optimum direction of reception and/or transmission of the array antenna when no electrical changes have been imposed on the antenna characteristics. Alternatively, the direction of the physical bore-sight axis is found as being substantially perpendicular to a plane which is mainly formed by the receiving/transmitting surface of the array antenna.

If electrical changes are introduced thereby altering the antenna characteristics, the direction of optimum transmission and/or reception will be changed. This electrically changed optimum direction is referred to as the electric boresight direction of transmission and/or reception. Here it should be understood that according to the solution provided by the present invention, the direction of electric boresight of reception is electrically changed in relation to the physical boresight axis, whereas the direction of the electric boresight of transmission is substantially unchanged in relation to the physical boresight axis.

In the following, different aspects of the present invention are mentioned. However, it should be noted that these aspects may apply for both the method and the systems of the invention. Thus, in order for the systems of the invention to be able to perform the listed aspects, the systems should include or comprise means specially adapted for these aspects.

In an aspect of the invention the electric characteristics of the feeding device are changed so that the direction of optimum reception or electrical boresight of reception is changed for any receiving signals having a frequency within an allocated receiving frequency band. It is also preferred that the transmit signal(s) is/are having a frequency within an allocated transmit frequency band. The electrically switching should be performed so that the frequency spectrum of a signal transmitted from the antenna of the first station mainly along the direction of optimum transmission or direction of electric boresight of transmission is substantially unaffected by said switching. Preferably, the electrically switching should be performed so that substantially no phase and/or amplitude distortion is imposed on signals transmitted from the first station mainly along the direction of optimum transmission or direction of electric boresight of transmission.

In an aspect of the invention the first station should further include transmit frequency filtering device coupled to the transmitting device of the first station for at least partly attenuating signals within the receiving signal frequency range, and receiving frequency filtering device coupled to the receiving device of the first station for at least partly attenuating signals within the transmit signal frequency range. Correspondingly, the method of the invention should further include at least partly attenuating signals within the transmit frequency range by receiving frequency filtering device coupled to the receiving device of the first station, and at least partly attenuating signals within the receiving frequency range by transmit frequency filtering device coupled to the transmitting device of the first station. Preferably, the receiving frequency filtering means should have a frequency characteristic different to the frequency characteristic of the transmit frequency filtering device, so that the receiving device and the transmitting device of the first station can operate in conjunction with the antenna substantially simultaneously but at different frequencies.

Preferably the second station is a communication satellite, which may be a stationary satellite or a repeater satellite, and the electromagnetic communication signals should be radio signals. Within satellite communication systems different frequency bands of communication may be defined, and for the communication systems of the present invention the receiving frequency filtering means should have a characteristic allowing frequencies in the range of 1525–1559 MHz to be passed without any substantial attenuation. Similarly, the transmit frequency filtering device should have a characteristic allowing frequencies in the range of 1626.5–1660.5 MHz to be passed without any substantial attenuation.

In order to electrically change the characteristics of the antenna, the antenna preferably has at least two array elements such as two patch elements. The changing of electric characteristics of the feeding device thus includes shifting, by use of a phase shifting device as part of the feeding device, the phase of signals received from the array elements.

In a preferred embodiment, the electrical feeding device is designed to operate mainly as a 50 ohm system, and it is also preferred that the receiving and transmit frequency filtering device are part of the feeding means. The receiving and transmit frequency filtering device should preferably represent a characteristic impedance substantially around 50 ohm within the frequency range of the received signals and the frequency range of the signals to be transmitted, respectively.

In a preferred embodiment the receiving filtering device are designed to have at least 40 dB, preferably at least 60 or 65 dB, attenuation of signals within the transmit signal frequency range. Similarly, the transmit filtering device is designed to have at least 40 dB, preferably at least 60 or 65 dB, attenuation of signals within the receiving signal frequency range.

In order to avoid changing of the direction of the electric boresight of reception due to transmit signals, the phase shifting device and the feeding device should be designed so that substantially no current or only a relatively small current is caused in the phase shifting means by transmit signals. Thus, it is preferred that the feeding device have a notch filtering device for attenuating signals mainly within the frequency range of the transmit signals thereby reducing attenuation requirements of the receiving frequency filtering device with respect to the transmit signal frequency range by at least 15 dB, preferably at least 20 dB.

Another advantage of this arrangement is that transmit power dissipation in phase shifters is reduced.

It is preferred that the phase shifted receiving signals are combined in such a way that the effects of the phase shifting have substantially no or only a relatively small effect on the generator impedance of the combined signal. Preferably, the phase shifting should be performed with a predetermined phase. However, solutions may also be provided in which the size of the shifted phase is a function of different parameters.

Several different designs of the antenna may be used, and the antenna may have a linear array of elements allowing the electrical changing of the direction of optimum reception to be performed within a first plane. However, in some cases it is preferred that the antenna includes a planar array of elements having at least four array elements allowing the electrical changing of the direction of optimum reception to be performed within a first plane and/or a second plane. The second plane may be substantially perpendicular to the first plane.

The phase shifting may be performed at different speeds or at different intervals. However, the phase shifting would usually be performed periodically. The frequency of the phase shifting should preferably be in the range of 1 Hz–500 kHz, more preferably in the range of 50–150 Hz, and even more preferably around 100 Hz. The phase shifting may be Controlled so that more changes of the direction of optimum reception are performed within the first plane than within the second plane during a predetermined period of time. Preferably, the electrical changing or switching of the direction of optimum reception is performed so that at least two directions of optimum reception are obtained within each plane of switching. The obtained directions of optimum reception within each plane may be separated a few degrees, for example 15°.

In a preferred embodiment the receiving signals from the antenna arrays, which signals may be phase shifted and output from the phase shifting device, are combined. The combined signal may be monitored, and the direction of the physical boresight axis of the antenna may be controlled on basis of variations in strength of the combined receiving signals. The combined signal may be an amplitude modulated signal due to differences in amplitudes of received signals caused by changes in the direction of optimum reception which may be caused by the phase shifting. A demodulated signal representing the amplitude differences includes in the combined signal may be generated and monitored.

In order to obtain an error signal to be used for controlling the direction of the physical boresight axis of the antenna, the monitoring of the demodulated signal should further comprise amplifying and filtering the demodulated signal during at least one period of phase shifting, in which period of phase shifting the direction of optimum reception should be electrically switched between at least two directions. In a preferred embodiment the sign of the amplification is substantially reversed in response to shifting of phases.

For the purpose of obtaining optimum signal to noise ratio in motor control servos, an optimum filtering or matched filtering of the demodulated signal may be required. Such filtering can be achieved by an so called integrate and dump filtering.

In order to control the physically boresight direction of the antenna the antenna should be mechanically moved, and the moving device for mechanically and/or angularly moving the antenna should comprise at least one axis motor, preferably two or three axis motors. A first axis motor might be adapted to move the antenna in azimuth, and/or a second axis motor might be adapted to move the antenna in elevation.

It is also an object of the invention to provide an electrical feeding device to be used in a tracking system for tracking an electromagnetic energy source, which may be a second station, with the tracking system having a first station with receiving device and transmitting device for transmitting and receiving electromagnetic communication signals, which first station further includes an array antenna for transmitting and receiving the electromagnetic communication signals to and from the energy source. The array antenna should have a direction of optimum transmission or direction of electric boresight of transmission being substantially constant in relation to a physical boresight axis of the antenna or an axis perpendicular to a plane mainly comprising the array antenna.

The electrical feeding device is used for coupling the array antenna to the receiving device and transmitting device of the first station, and the electrical feeding device includes a duplexer device for coupling said antenna to the receiving means and transmitting means of the first station, and phase shifting means for electrically changing or switching the direction of optimum reception or electric boresight of reception of the antenna of the first station in one or more directions displaced from the direction of the physical boresight axis.

It is preferred that the duplexer include a transmit frequency filtering device coupled to the transmitting device of the first station for at least partly attenuating signals within the receiving signal frequency range, and receiving frequency filtering device coupled to said receiving device of the first station for at least partly attenuating signals within the transmit signal frequency range. The receiving frequency filtering device should have frequency characteristics different from the frequency characteristics of the transmit frequency filtering device, so that the receiving device and the transmitting device of the first station can operate in conjunction with the antenna substantially simultaneously but at different frequencies.

Preferably, the phase shifting device are adapted to change the direction of optimum reception or electrical boresight of reception for any receiving signals having a frequency within an allocated receiving frequency band. It is also preferred that the duplexer device are adapted to pass transmit signals within an allocated transmit frequency band from the transmitting means to the antenna.

The above mentioned embodiments of the phase shifting device and the receiving and transmit filtering device of the systems of the invention should also be considered for use in embodiments of the electrical feeding device according to the invention.

Embodiments and details of the system appear from the claims and the detailed discussion of embodiments of the system given in connection with the figures.

Figure 1B:
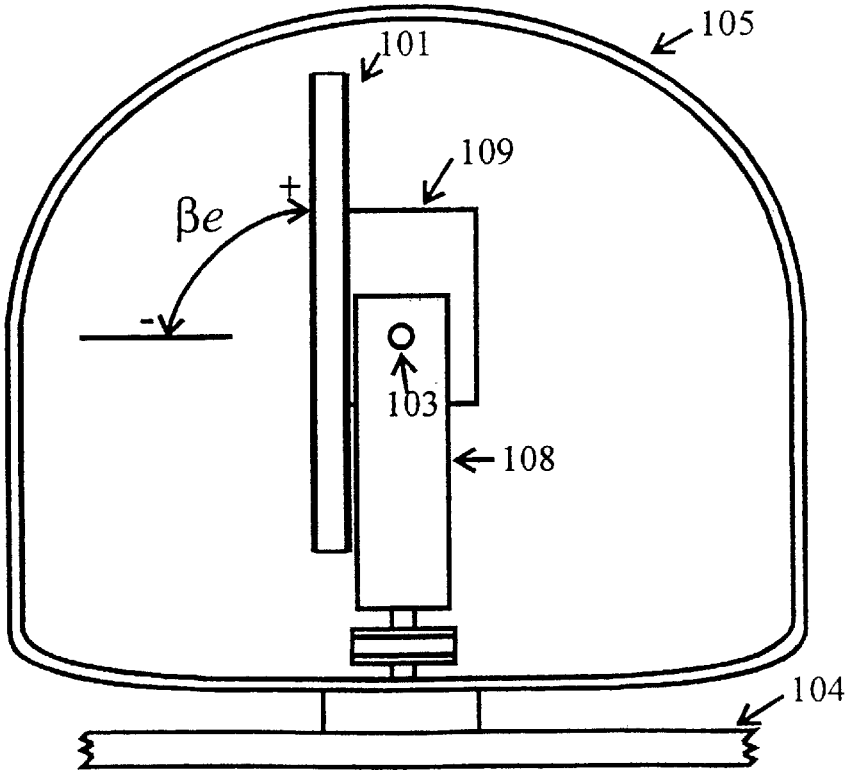
Figure 2A:
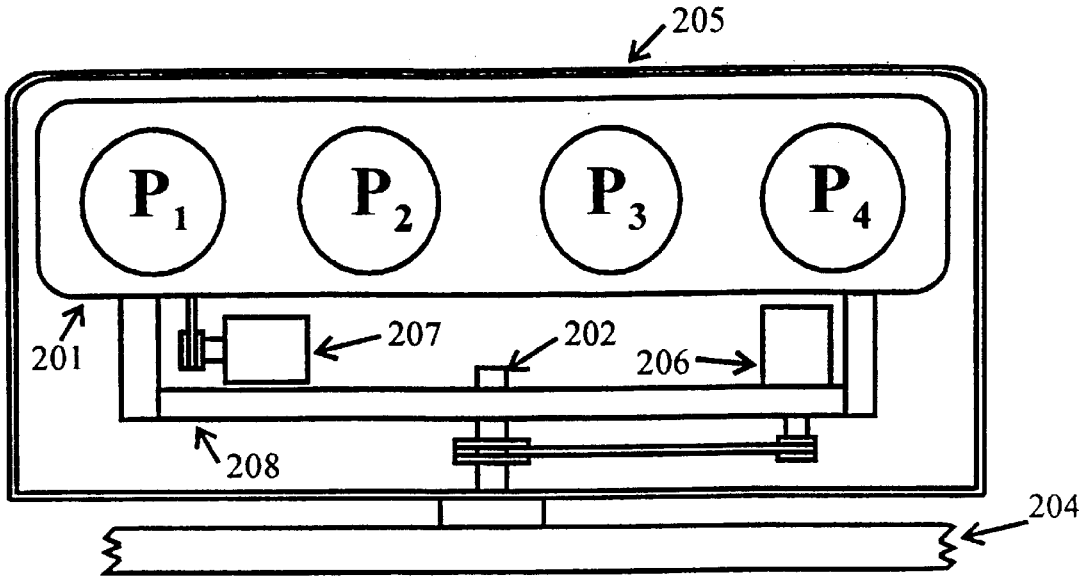
Figure 2B:
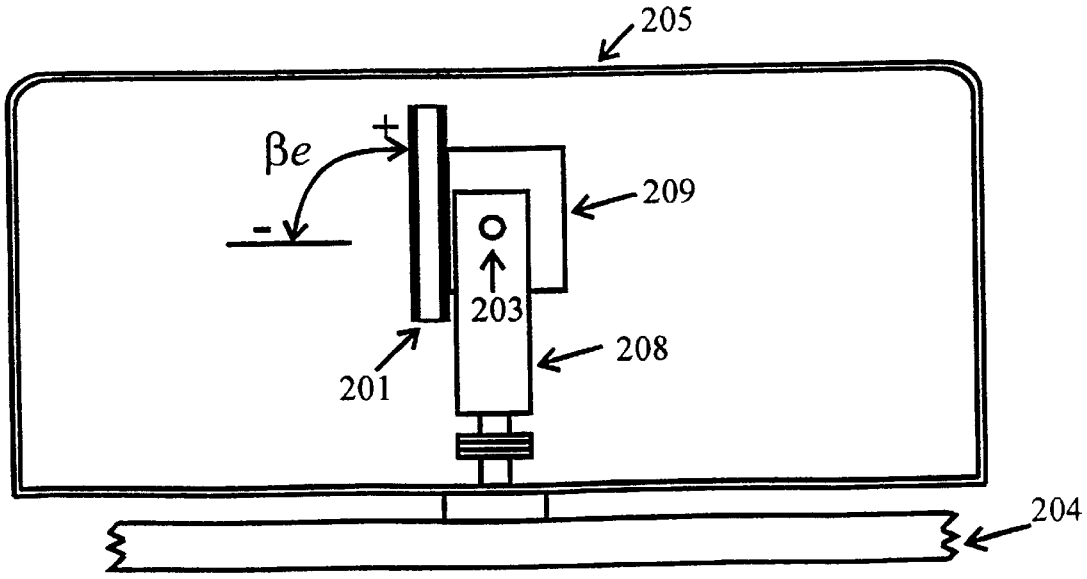
Figure 3A:
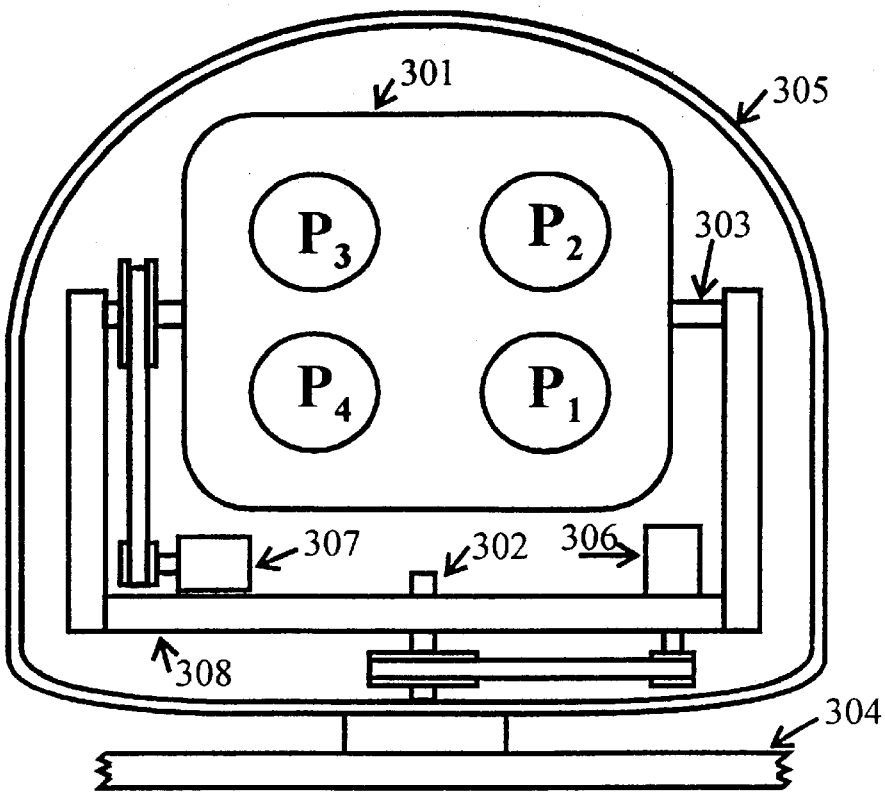
Figure 3B:
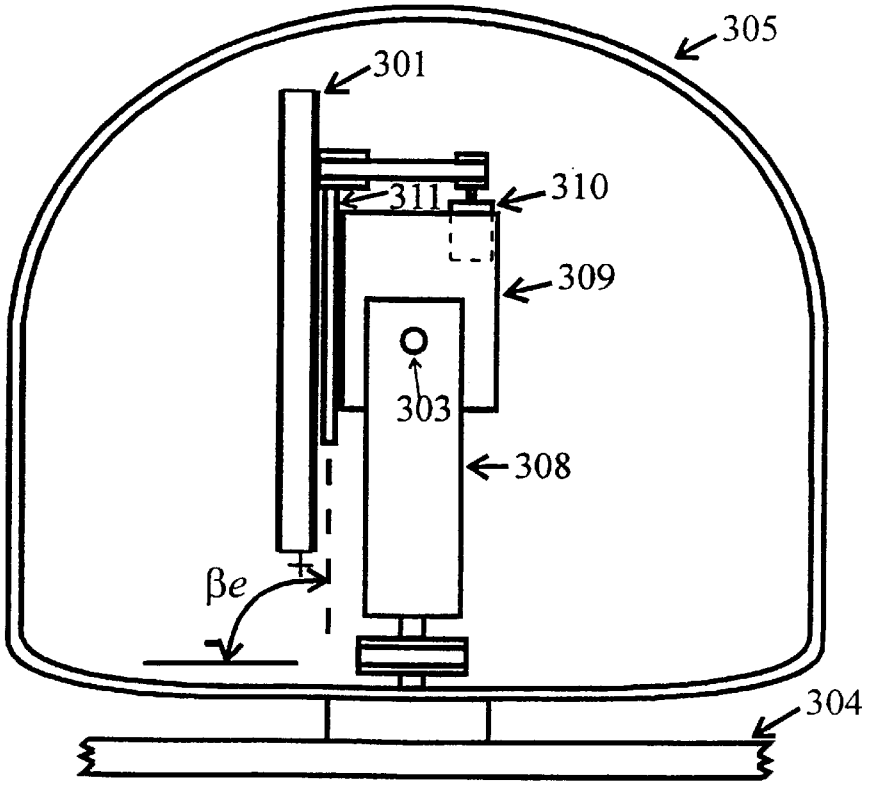
Figure 4:
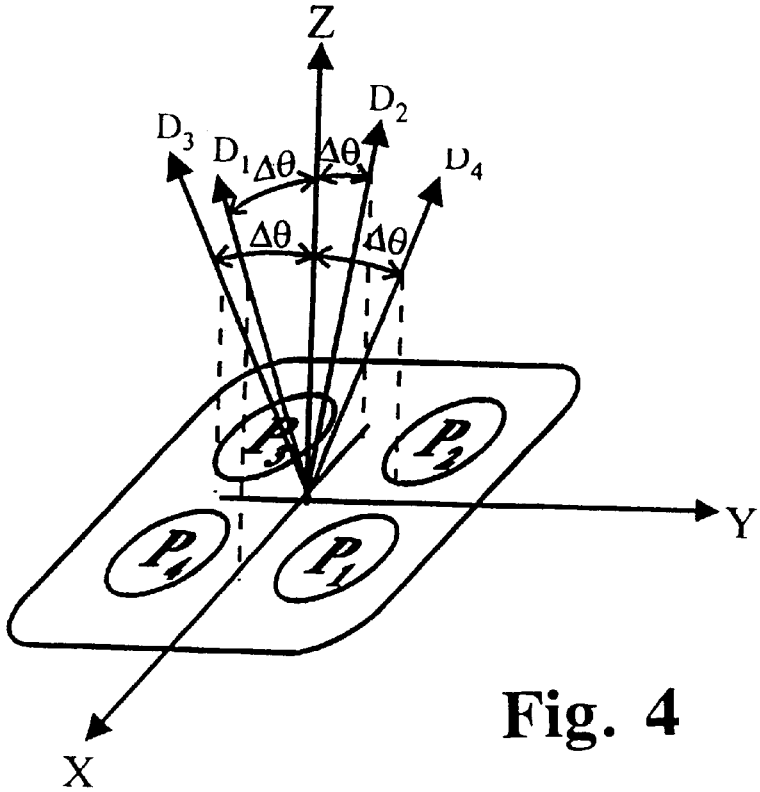
Figure 5:
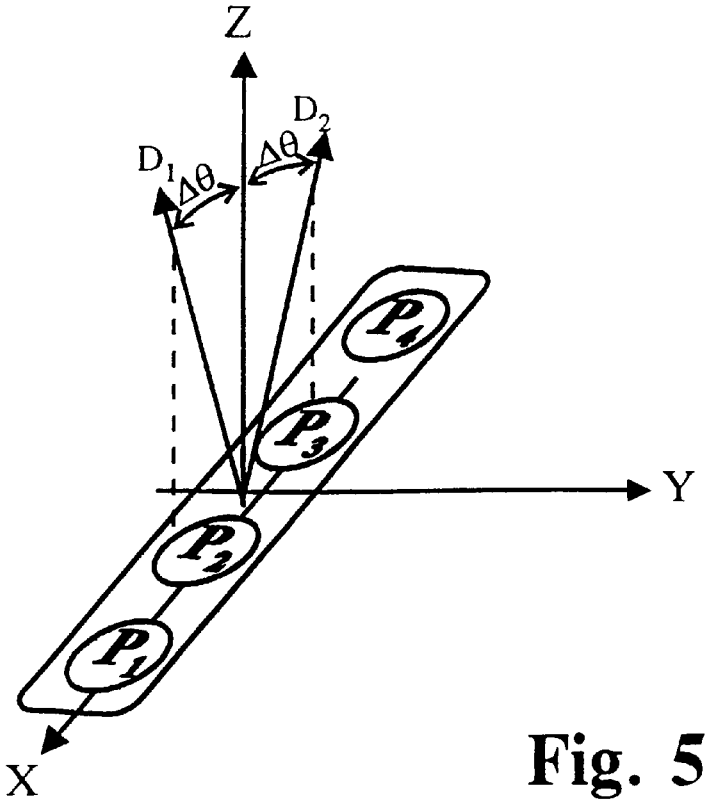
Figure 6:
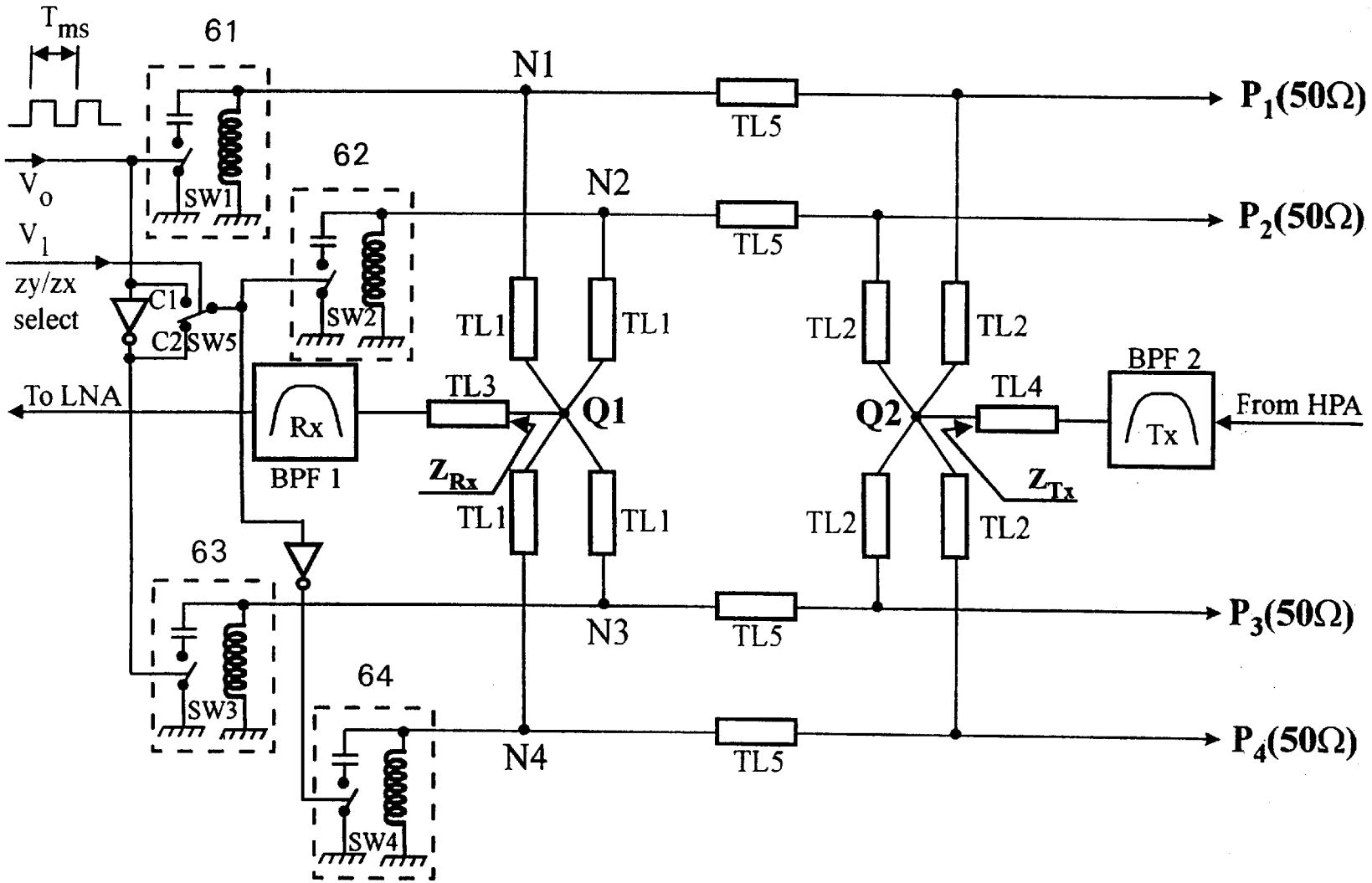
Figure 7:
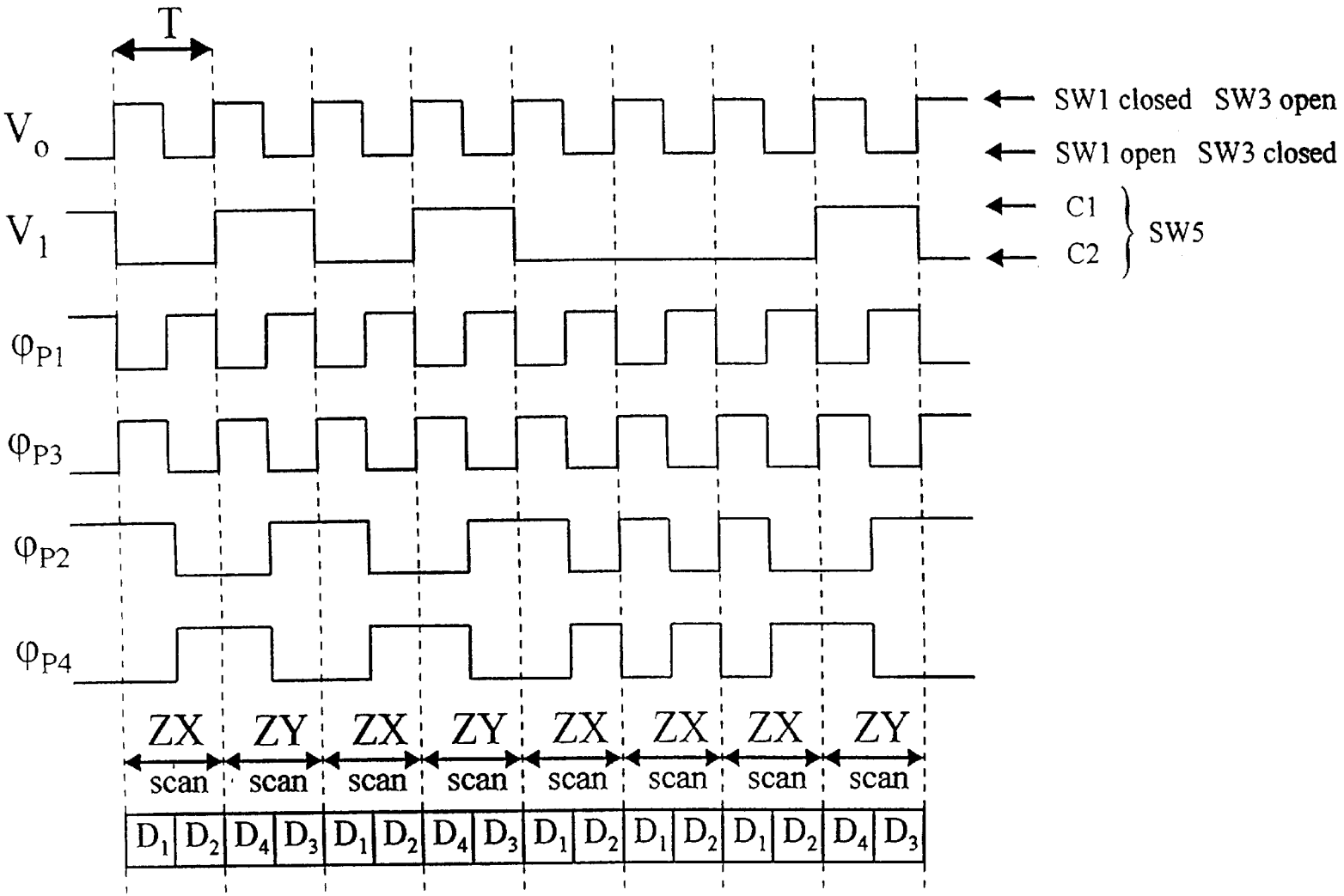
Figure 9:
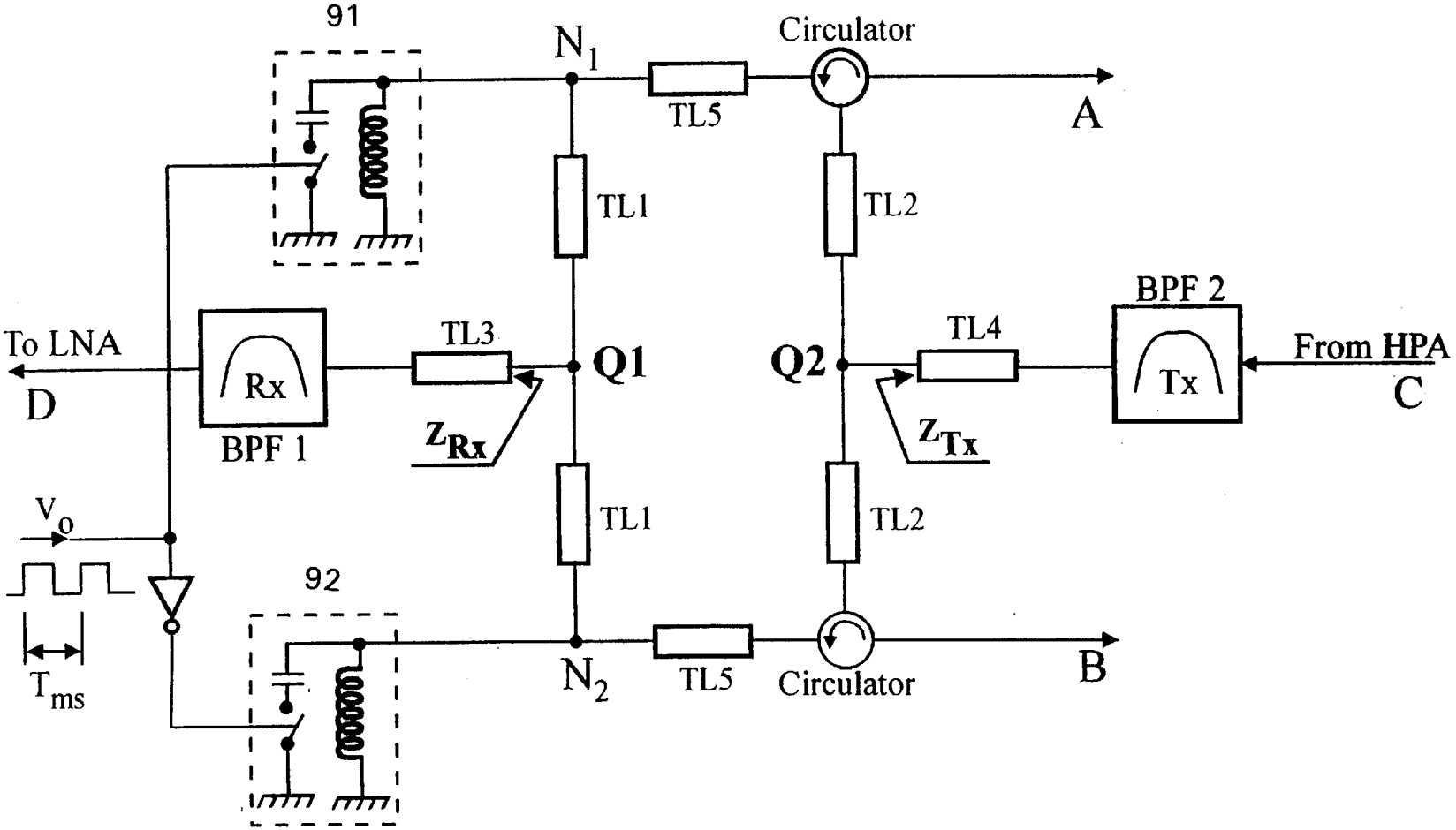
Figure 10:
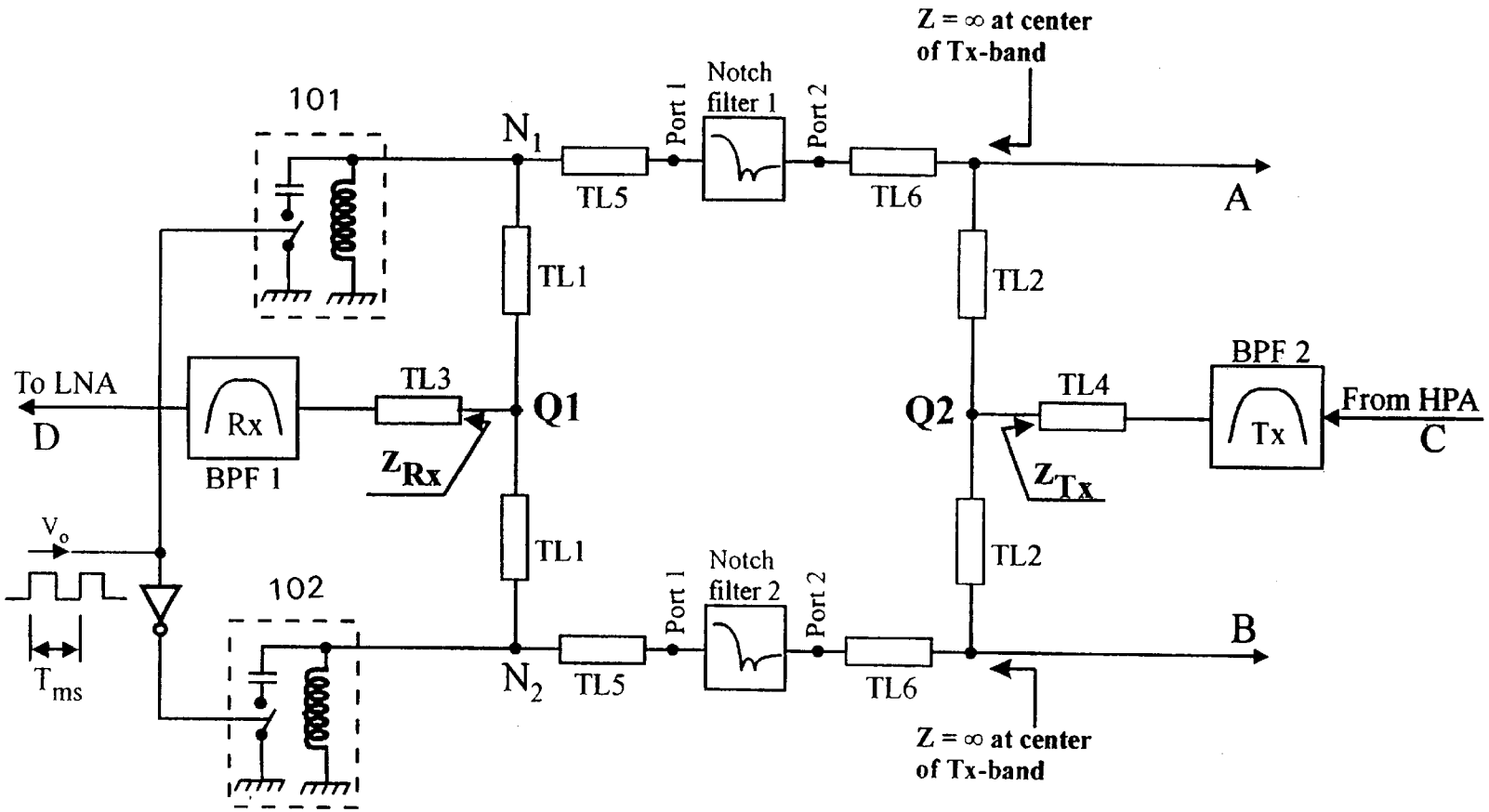
Figure 11:
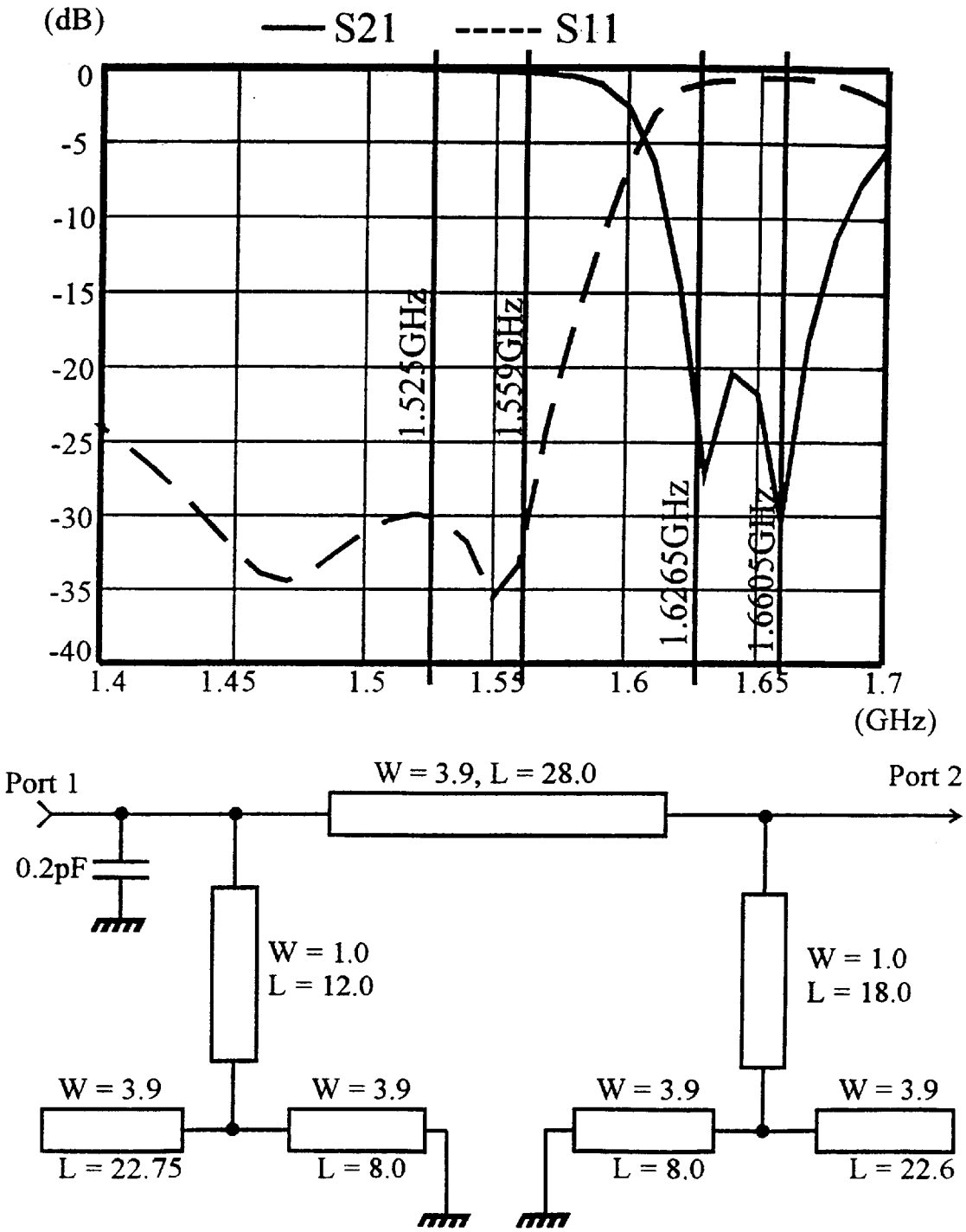
Figure 12:
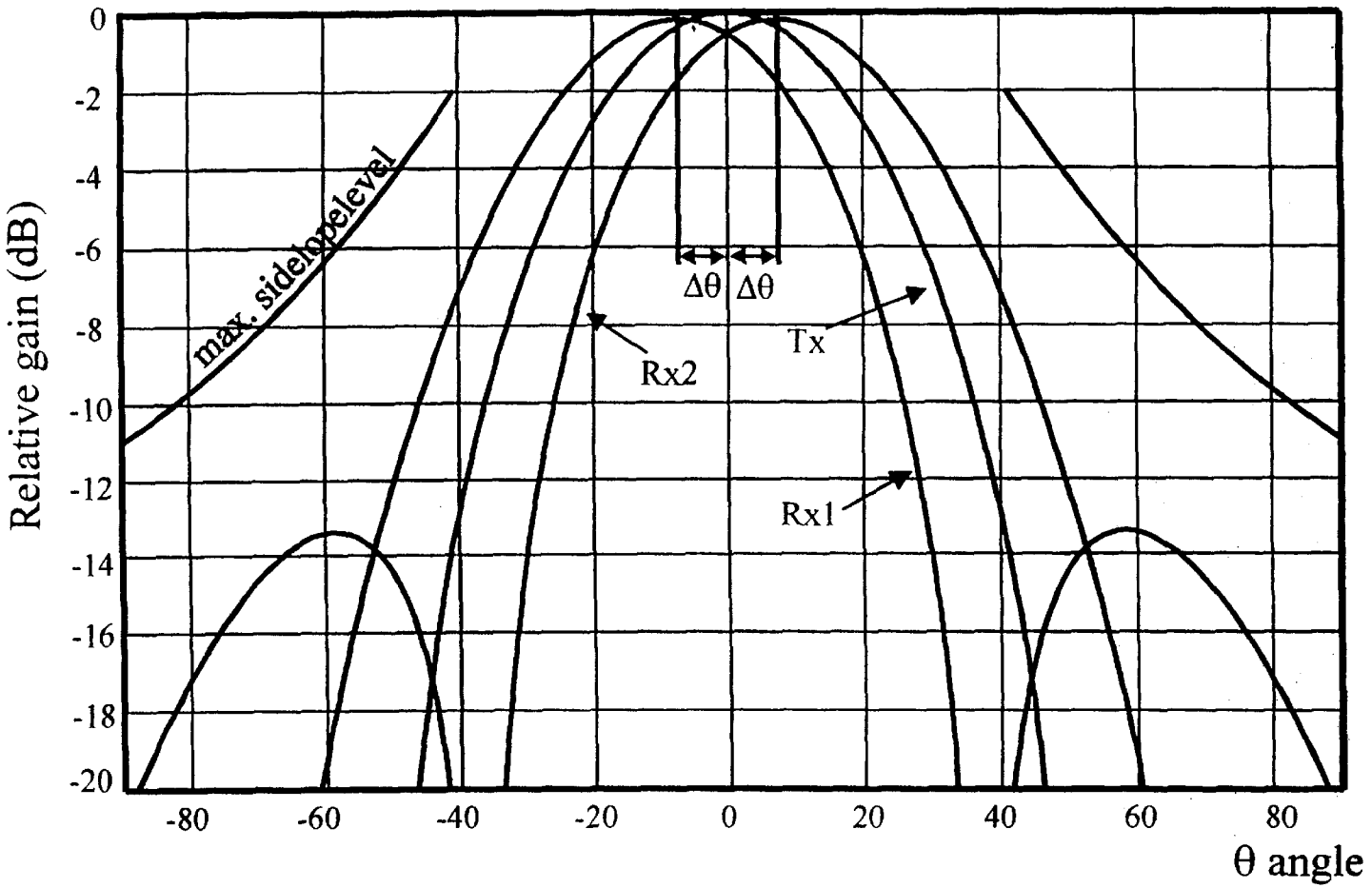
Figure 13:
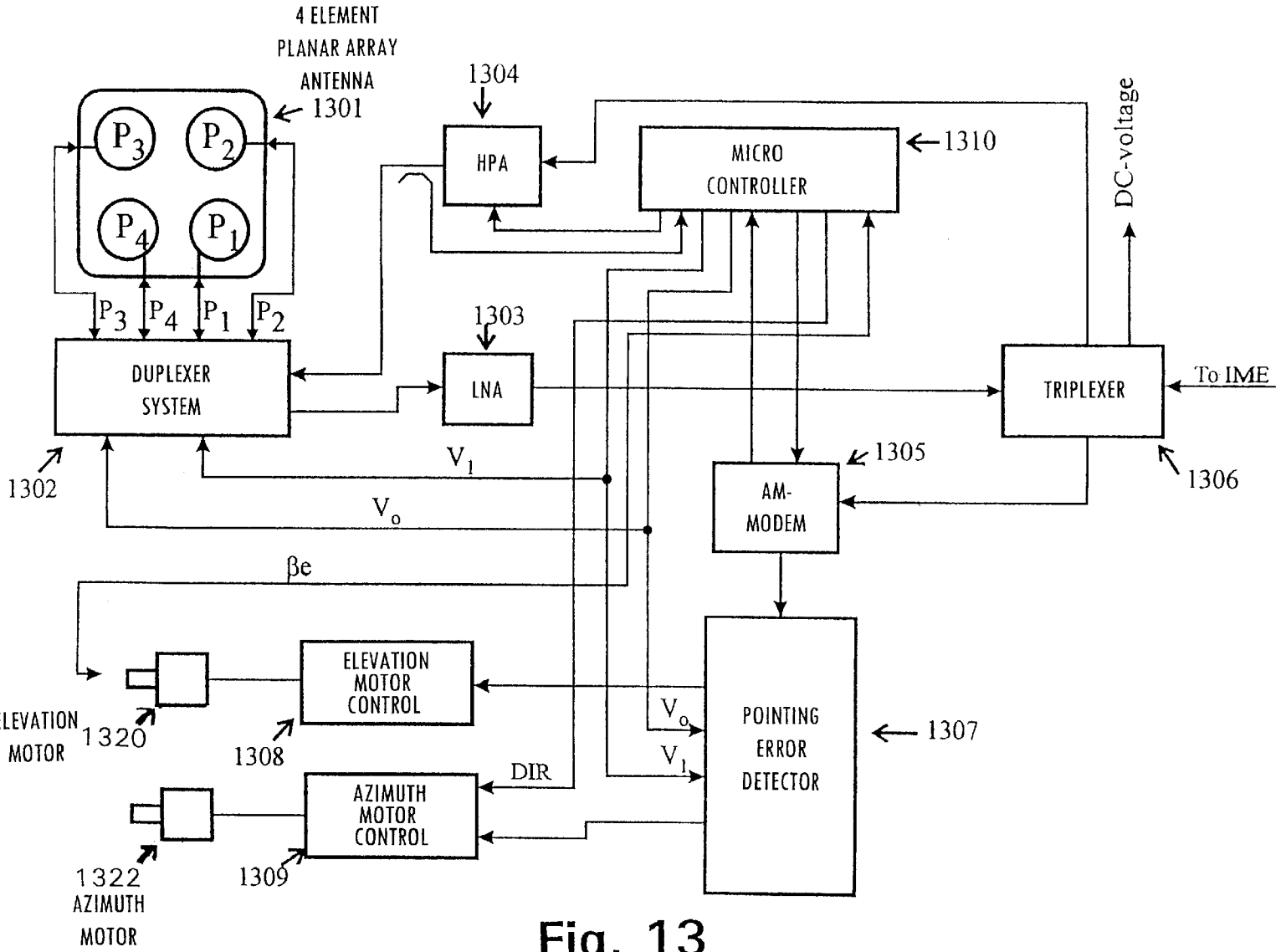
Figure 14:
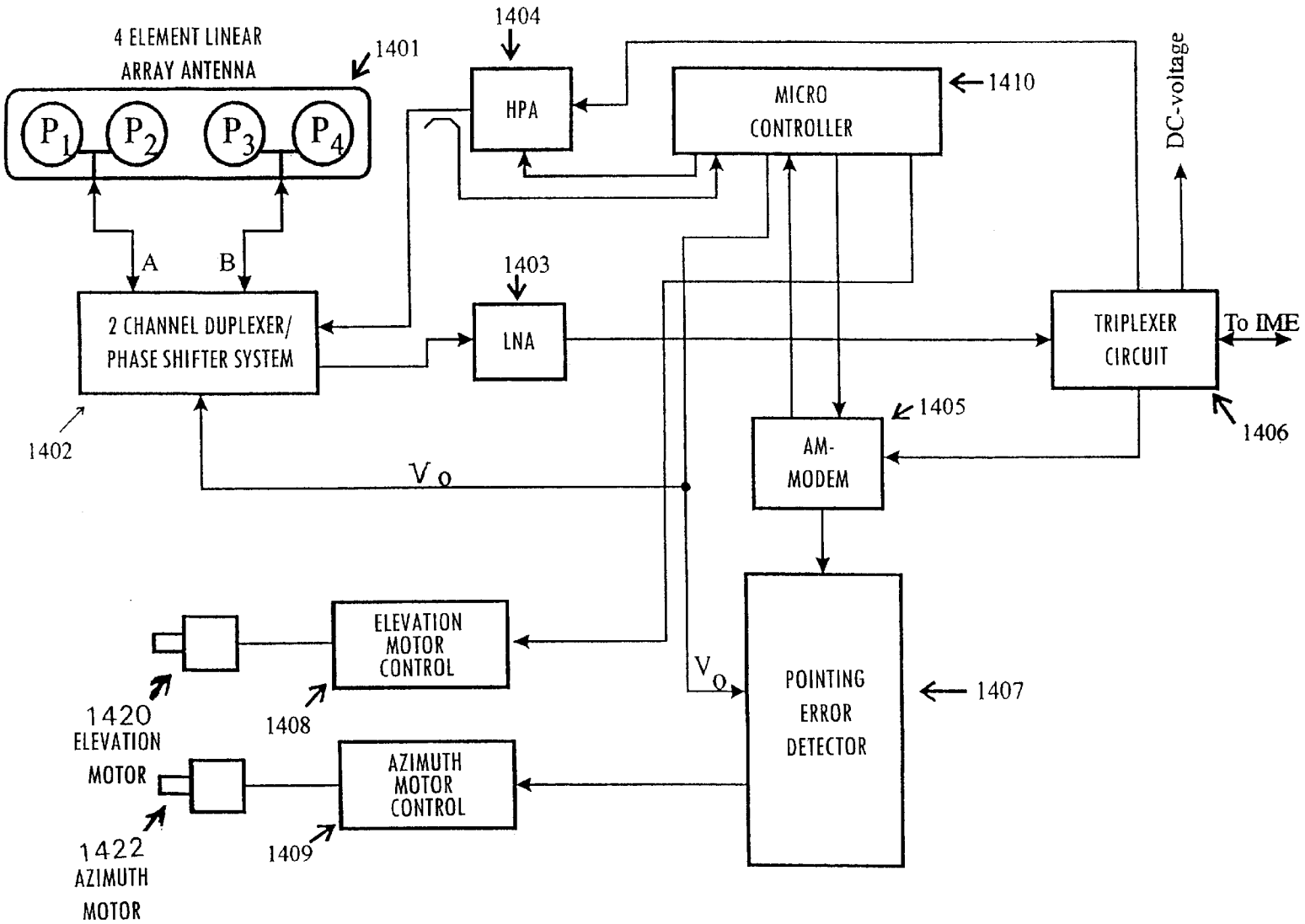
Figure 15:
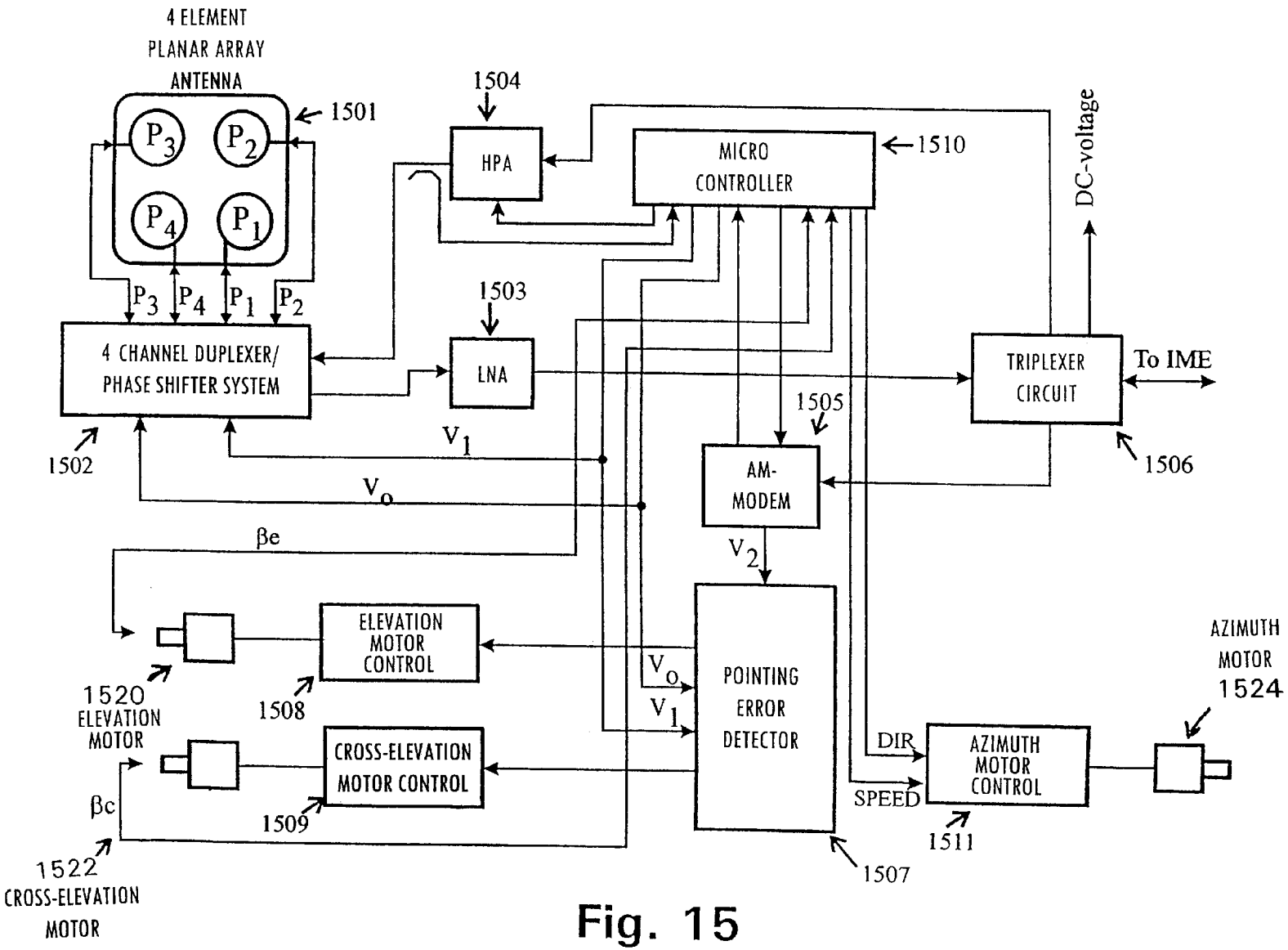
Figure 16:
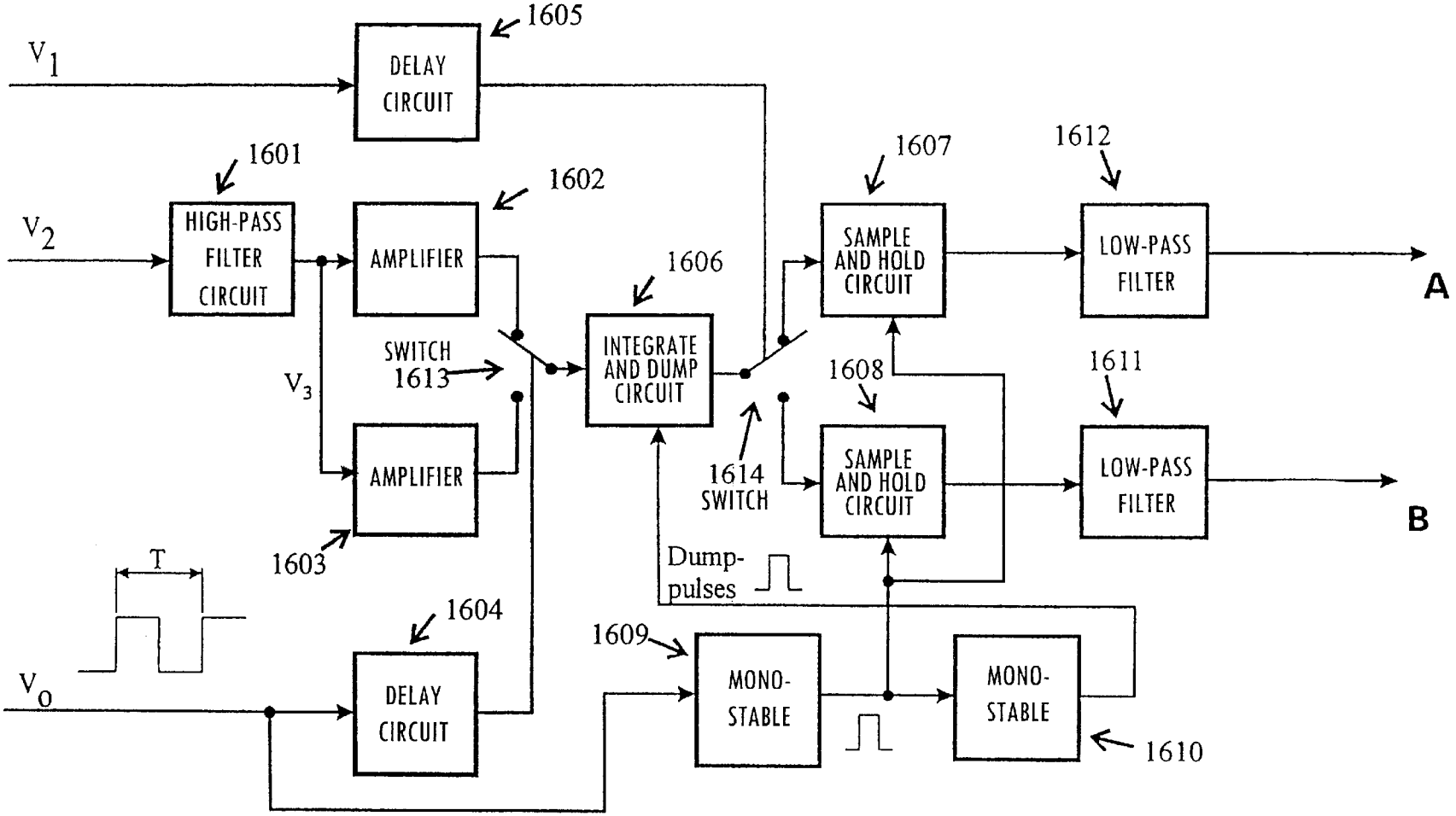
Figure 17:
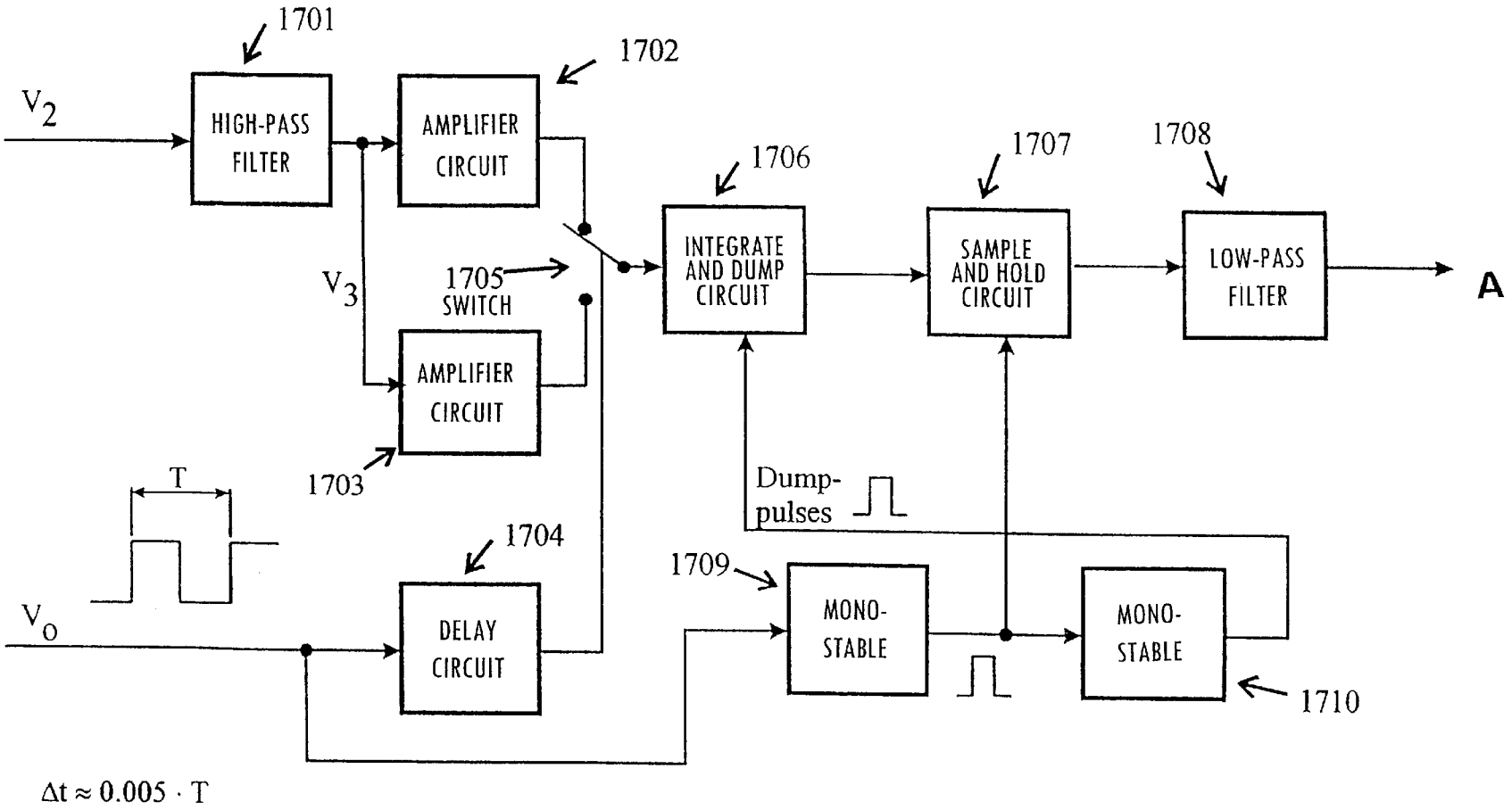
Figure 18:
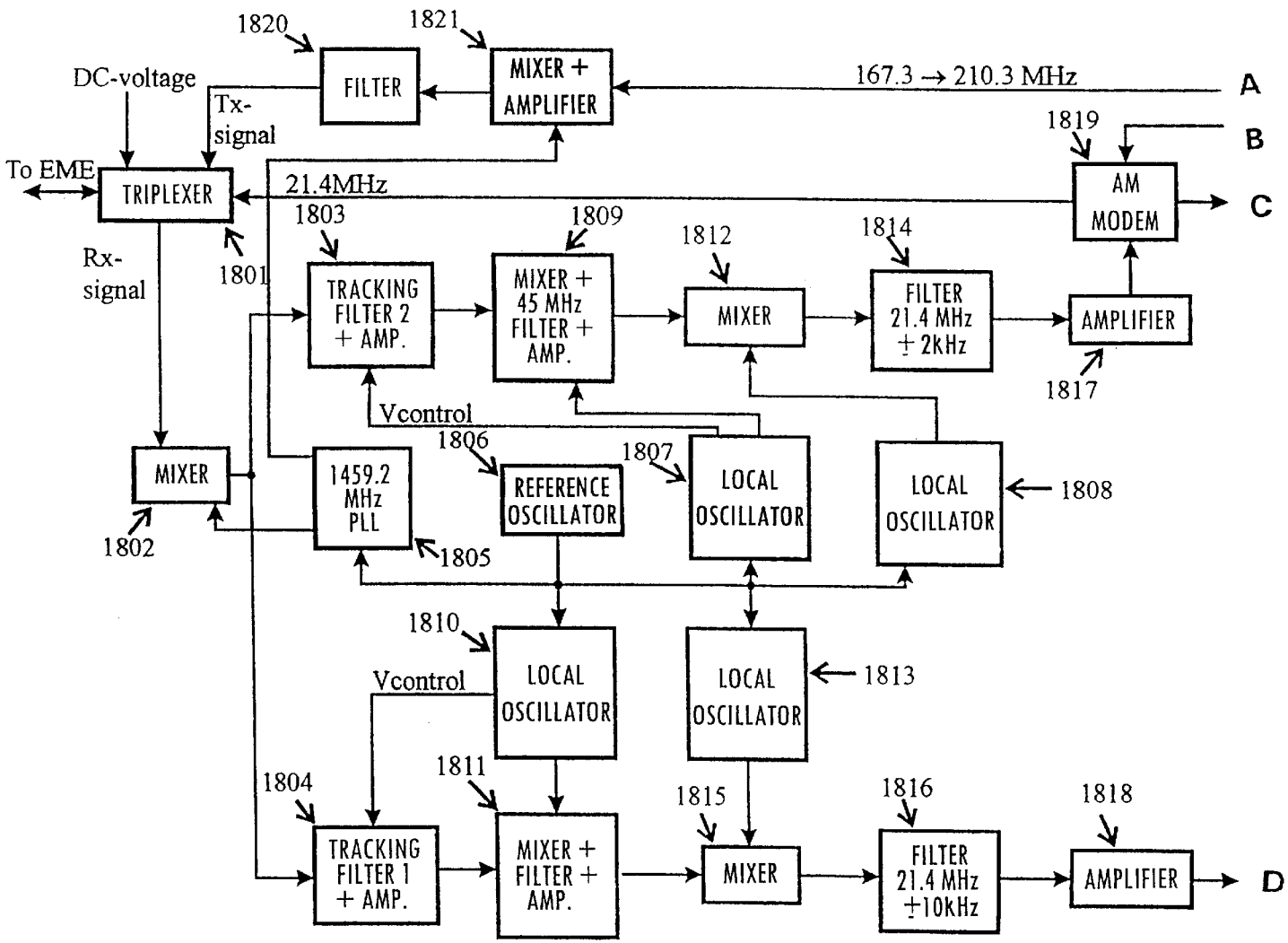

The invention will now be described in further details with reference to the accompanying drawings in which:

FIGS. 1*a* and 1*b* show a front view and a side view of a first embodiment of a system according to the present invention in which angular rotation can be performed around two axes, FIGS. 2*a* and 2*b* show a front view and a side view of a second embodiment of a system according to the system of FIG. 1, FIGS. 3*a* and 3*b* show a front view and a side view of a third embodiment of a system according to the present invention in which angular rotation can be performed around three axes, FIG. 4 illustrates the principles of beam switching of a four element planar array antenna, where $D_1$, $D_2$,$D_3$, and $D_4$ are directions of maximum gain, FIG. 5 illustrates the principles of beam switching of a four element linear array antenna, where $D_1$ and $D_2$ are directions of maximum gain, FIG. 6 shows an embodiment of a 4 channel duplexer/phase shifter circuit according to the present invention for beam switch in two planes, FIG. 7 illustrates phase shifting of receiving signals, FIGS. 8*a*, 8*b*, 9 and 10 show embodiments of duplexer/phase shifter circuitry according to the present invention for beam switch in one plane, FIG. 11 shows an embodiment of a notch filter according to the present invention, FIG. 12 shows a radiation pattern of an antenna according to the present invention where beam switch is performed on receiving frequencies but not on transmit frequencies, FIG. 13 shows an example of a block diagram of the system of FIG. 1, FIG. 14 shows an example of a block diagram of the system of FIG. 2, FIG. 15 shows an example of a block diagram of a system corresponding to the embodiment shown in FIG. 3, FIG. 16 shows an example of a block diagram of a version of a pointing error detector to be used in the systems of FIGS. 13 and 15, FIG. 17 shows an example of a block diagram of an embodiment of a pointing error detector to be used in the system of FIG. 14, and FIG. 18 shows an example of a block diagram of an embodiment of a dual channel receiver according to the invention.

The system of the present invention may be an electromechanical system, more specific the EME of a mobile terminal. The EME is meant to be installed on a suitable platform of a vehicle such as a ship or car. The purpose of the system is to perform stabilization of e.g. an array antenna used for reception of radio signals from and transmission of radio signals to a satellite in such a way that G/T and EIRP (including antenna pointing error) meet required specifications. The design principles of preferred systems of the present invention are such that cost, size weight and complexity are kept relatively low.

Simultaneous to the antenna stabilization the electromechanical system can perform satellite tracking. The electromechanical system according to the present invention has the following advantages:

1) No information from external devices such as vehicles gyro or compass e.g. fluxgate is required and, furthermore, no information regarding geographical position from e.g. a GPS receiver is needed.
2) The control of up to two axis motors of the electromechanical system can be performed by information from a receiver that can be tuned to receive a constant carrier or modulated carrier signal from the satellite. An IF (Intermediate Frequency) output signal from the receiver can be amplitude demodulated and used for controlling the axis motors. In some applications the receiver may be used to control only one axis motor.
3) The electromechanical system may preferably incorporate a planar or linear array antenna and a filter system (duplexer system) with phase shifters such that the pattern of the antenna of receiving frequencies can be switched between two states in one plane for the linear array and one or two planes for the planar array and still fulfil specifications with respect to sidelope.

The number of switch actions per second (1/T) may be selected to optimize performance taking into consideration radio signal fading phenomenons etc. The phase shifters together with the filter system can shift the phase of a signal in the receiving band mainly without affecting the phase or amplitude of a signal being transmitted at a transmit frequency, which transmit frequency preferably is different from the frequencies of the receiving band. Typically, receiving frequencies and transmit frequencies are allocated in relatively narrow bands with the center frequencies of the bands being separated by a few percent.

System:

The invention can preferably be embodied in an EME having a number of axis ranging from one to four, each embodiment having its own advantages and disadvantages. FIGS. 1, 2 and 3 show three systems having different axis configurations.

The embodiment illustrated in FIGS. 1*a* and 1*b* is best suited where the moving platform may be exposed simultaneously to both moderate pitch and moderate roll angles but a high rate of turning or rotation, e.g. the movements of a car. The system of FIG. 1 comprises a planar antenna 101, and due to the square shape of the antenna 101 the EME will be relatively high which makes it well suited for installation on a metal plate such as the keep house roof of a truck where sudden obstacles may be expected. It is not applicable where a low profile EME is required. The number of patch elements P1, P2, P3 and P4 in the antenna 101 is shown as four but could be any such number that enables the radiation pattern to be switched in one or two planes.

The embodiment of FIG. 1 comprises two mechanical axis, an azimuth axis 102 which is perpendicular to a platform 104 and an elevation axis 103 which is parallel to the platform 104. The azimuth axis 102 may have cable unwrap and have a rotation angle of e.g. 540°, or it may have a rotary joint with unlimited rotation. The elevation axis 103 may have approximately 85° rotation. A frame 108 is used to support the elevation axis and two motors 106 and 107 which are used to make the antenna perform angular rotation about the azimuth and elevation axes, respectively. All electronics such as low noise amplifier, high power amplifier, phase shifters, duplexer system, receiver and transmitting system, motor drivers and control circuits may be accommodated in an enclosure 109 at the back of the antenna 101 or somewhere else in the structure.

For the system shown in FIGS. 2*a* and 2*b* the reference numerals 202–209 correspond to the reference numerals 102–109 in FIG. 1. The embodiment shown in FIGS. 2*a* and 2*b* comprises a linear array antenna 201 and this system is best suited when the moving system platform 204 may be exposed simultaneously to both moderate pitch and moderate roll angles but a high rate of turning or rotation, e.g. the movements of a car, but where also a low profile is a must. The antenna 201 has four patch elements P1, P2, P3 and P4 but the number of patch elements could be any such number that enables the radiation pattern to be switched in one plane.

FIGS. 3*a* and 3*b* show a system having three axes. This embodiment is best suited where the moving platform may be exposed simultaneously to both high pitch and roll angles and high turn rate. e.g. the movements of a small vessel. The system comprises a planar antenna 301 having four patch elements P1, P2, P3 and P4 similar to the antenna 101 of FIG. 1, and the number of patch elements could be any such number that enables the radiation pattern to be switched in two planes.

The embodiment comprises three mechanical axes, the azimuth axis 302, the elevation axis 303 and the cross-elevation axis 311 and three corresponding motors 306, 307 and 310 being supported by a frame 308. When the antenna 301 is parallel to the azimuth axis 302 the cross-elevation axis 309 will also be parallel to the azimuth axis. the third motor 310 is used for performing angular rotation about the cross-elevation axis via suitable gears e.g. belt and pulleys.

The rotation angle of the azimuth axis is e.g. 540° if cable unwrap is used and unlimited if a rotary joint is used. The rotation angle of the elevation axis has preferably a minimum of 165° and the rotation angle is preferably about 70° for the cross-elevation axis.

Antennas:

In general the antennas shall be designed in such a way that the direction of the antenna main lope can be switched (beam switch) a few degrees in one plane or two planes perpendicular to each other. Examples of suitable antenna types are the linear and the planar array antennas comprising a sufficient number of array elements e.g. patch elements.

FIG. 4 shows a four element planar array with the possibility of performing beam switch in two planes, and FIG. 5 shows a four element linear array with the possibility of performing beam switch in only one plane. Receiving signals from each of the four patch elements P1, P2, P3 and P4 in FIG. 4 are routed to a summing point via phase shifters with only two possible values of phase shift thereby enabling the direction of the main lope of the antenna to be changed a few degrees (delta theta) in the XZ plane as well as (but not simultaneously) a few degrees (delta theta) in the ZY plane.

Receiving signals from each of the four patch elements in FIG. 5 are routed to a summing point via phase shifters with only two possible values of phase shift thereby enabling the direction of the main lope for the antenna to be changed a few degrees (delta theta) in the XZ plane.

Duplexer/Phase Shifter System:

A preferred system according to the present invention comprises duplexer/phase shifter circuitry. The purpose of the duplexer/phase shifter circuitry is to ensure that a receiver tuned to a proper receiving frequency (Rx-frequency) and a transmitting tuned to a proper transmit frequency (Tx-frequency) can operate at the same antenna at the same time. This implies that a strong transmit signal (Tx-signal) shall be sufficiently attenuated in order not to cause blockage of the receiver. Preferably, the high noise level from the transmitting should also be attenuated.

Furthermore, the duplexer/phase shifter system or circuitry can enable the phase of the Rx-signal from each individual patch element or group of patch elements to be shifted in phase while introducing no substantial phase shift of the Tx-signals to each patch element. The phase shift of Rx-signals will cause the direction of maximum gain of the antenna to be shifted a few degrees relative to a normal to the antenna plane, i.e. the shift of direction will occur for signals within the receiving frequency range only, and thus not for signals within the transmit frequency range.

FIG. 6 shows an example of the duplexer/phase shifter circuit designed to operate as a 50 ohm system, i.e. antenna patches represent approximately 50 ohm in the transmit and receiving bands, BPF 1 represents approximately 50 ohm in the Rx-band and BPF 2, represents approximately 50 ohm-in the Tx-band. BPF 1 is a filter that passes one or more signals within the receiving frequency range but attenuates or rejects one or more high-level transmit signals Tx-signal, i.e. a signal from a high power amplifier HPA within the transmit frequency range. BPF 2 is a filter that passes one or more signals within the transmit frequency range but attenuates or rejects one or more signals within the receiving frequency band.

Phase shifters 1, 2, 3 and 4 (reference numerals 61, 62, 63, and 64) are identical phase shifters. They are shown as LC tank circuits in which a capacitor can be switched in and out. A practical realisation would be by using of PIN diodes in a microstrip circuit. Phase shifter 1 (61) represents a load admittance Y1 to node N1. Y1=(GL+jBL) when the capacitor is switched in and Y1=(GL−jBL) when the capacitor is switched out. The phase shifters shall preferably be designed so that the value of GL is relatively small in order to minimize losses whereas BL shall have a value which causes the receiving signal from patch port P1 to be shifted in phase. Phase shifters 2, 3 and 4 (62, 63, and 64) have a similar effect on receiving signals from patch ports P2, P3 and P4. In the preferred embodiment patch ports P1, P2, P3 and P4 are connected via suitable transmission lines to e.g. patches P1, P2, P3 and P4 as shown in FIG. 4.

BPF 1 and BPF 2 are connected via a system of transmission lines TL1, TL2, TL3, TL4 and TL5 having characteristic impedances approximately as indicated in FIG. 6. It is preferred that TL3 has an electric length so that the impedance ZRx of TL3 is very high at the center of the Tx-signal band. It is also preferred that TL4 has an electric length so that the impedance ZTx of TL4 is very small at the center of the Rx-signal band. Preferably, the transmission lines TL1 and TL5 have an electric length of about 90° at the center of the Tx-signal band, and preferably the transmission lines TL2 have an electric length of about 90° at the center of the Rx-signal band. The effect of this system is that Tx-signal power from the HPA will be equally shared between patches P1, P2, P3 and P4 and that a Tx-signal will cause no or only a very small current in the phase shifters since they are all at a voltage zero or very close to a voltage zero at Tx-signal frequencies. For this reason PIN diodes in the phase shifters can be low power versions and, furthermore, the phase shift action will have no or very little effect on the Tx-signals fed to the patches P1, P2, P3 and P4.

On the other hand, the phase of a Rx-signal from the patches P1, P2, P3, and P4 will be shifted by phase shifters 1, 2, 3 and 4 (61, 62, 63, and 64) respectively. As shown in FIG. 6 there will always be two phase shifters representing (GL+jBL) and two phase shifters representing (GL−jBL) so that when signals from patches P1, P2, P3 and P4 are combined in node Q1, the generator impedance as seen from BPF 1 is mainly constant, i.e. unaffected by the phase shift action and hence the antenna beam switch. This feature is important since a change in generator impedance could cause the gain and noise figure for a low noise amplifier LNA amplifying the output of BPF 1 to change and hence disturb antenna stabilization.

The system of FIG. 6 has the following characteristics:
TL1/TL5: electric length=90° at center of Tx band.
TL2: electric length=90° at center of Rx band.
TL1: $Z_0$=100 Ω.
TL2: $Z_0$=100 Ω.
TL3: $Z_0$=50 Ω.
TL4: $Z_0$=50 Ω.
TL5: $Z_0$=50 Ω.

In FIG. 6 the phase shifters 1 and 3 (61 and 63) are shifted periodically with the frequency f=1/T as indicated by control input signal V0. Another control input signal V1 is used for controlling in which plane ZY or ZX the beam switch takes place. The signals V0 and V1 are illustrated in FIG. 7 together with the relative phases of the receiving signals coming from patches P1, P2, P3 and P4. Also the direction of maximum gain is shown with reference to FIG. 4. During one period T one complete scan is performed where a scan is a sequence in which the direction of maximum antenna gain may be D1, D2, D3 or D4 (see FIG. 4) for a period of ½T and in the opposite direction for a period of ½T, where opposite directions are in the same plane. For example, D2 is opposite to D1 and D4 is opposite to D3.

In FIG. 7, $\phi_{P1}$ is the relative phase of Rx-signal from patch $P_1$, measured in node Q1, $\phi_{P3}$ is the relative phase of Rx-signal from patch $P3_1$, measured in node Q1, $\phi_{P2}$ is the relative phase of Rx-signal from patch $P_2$, measured in node Q1, and $\phi_{P4}$ is the relative phase of Rx-signal from patch $P_4$, measured in node Q1.

The scans do not have to be equally shared between the two planes XZ and ZY. For example, if antenna stabilization about the Y axis (see FIG. 4) is more critical than stabilization about the X axis, a higher share of the scans can be allocated to the XZ plane.

Figure 8A:
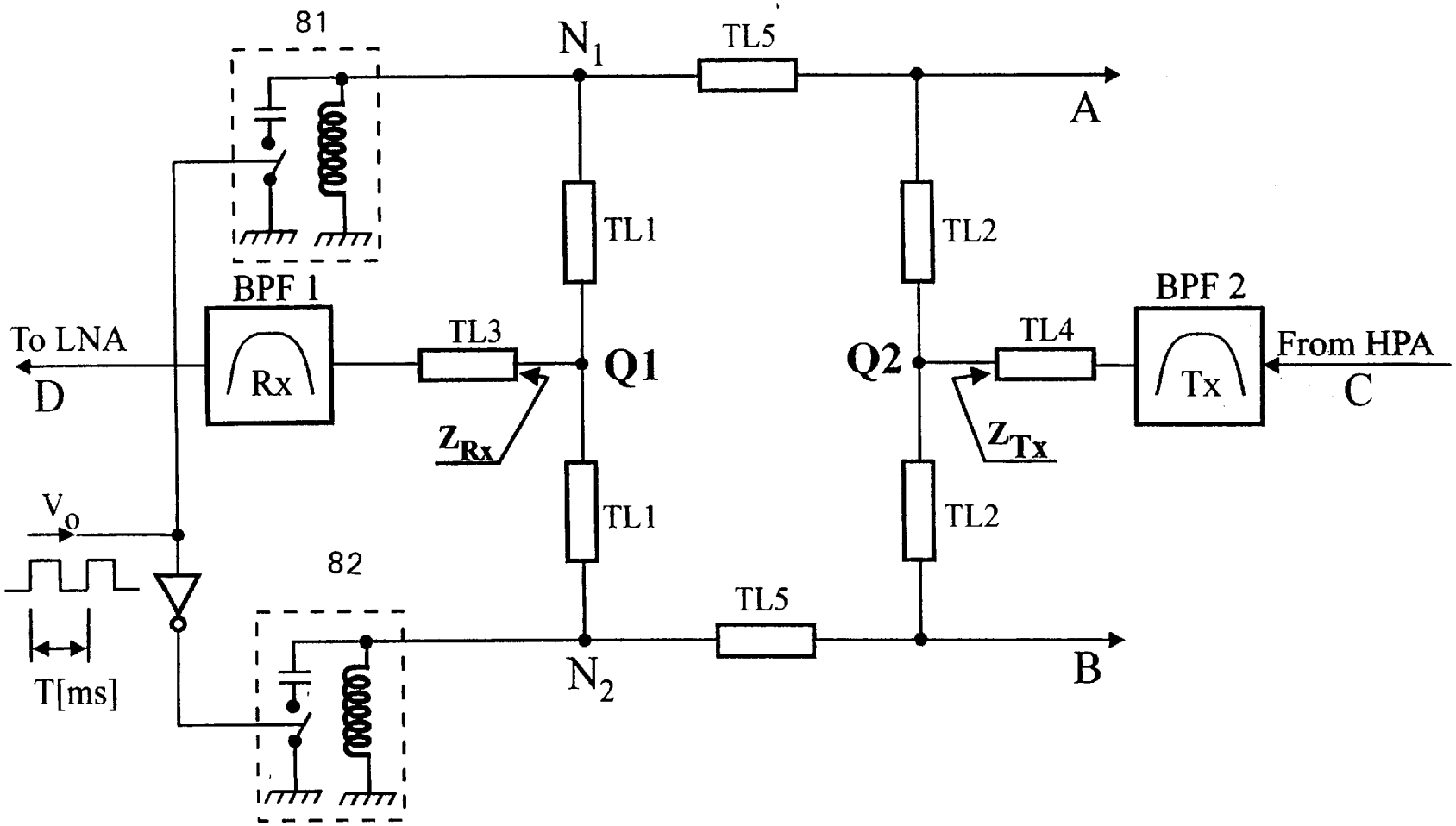

FIG. 8*a* shows a more simple version of a 2 channel duplexer/phase shifter circuitry which is best suited for systems where beamswitch is required in only one plane as illustrated in FIG. 5. In this case only two patch elements or two groups of patch elements are used, so only two phase shifters (81 and 82) are needed. The function of the circuitry of FIG. 8*a* corresponds to that of FIG. 6 but the characteristic impedances of transmission lines TL1 and TL2 are changed to about 71 ohm.

The system of FIG. 8*a* has the following characteristics:
TL1/TL5: electric length=90° at center of Tx band.
TL2: electric length=90° at center of Rx band.
TL1: $Z_0$=71 Ω.
TL2: $Z_0$=71 Ω.
TL3: $Z_0$=50 Ω.
TL4: $Z_0$=50 Ω.
TL5: $Z_0$=50 Ω.

In FIG. 8*a* output A is to a single patch element or a group of patch elements, e.g. $P_1$+$P_2$, and output B is to a single patch element or a group of patch elements, e.g. $P_3$+$P_4$.

Antenna sidelopes for the 4 element linear array can be substantially reduced by utilizing amplitude tapering, i.e. the two innermost elements are fed at a higher power level than the two outermost elements. Unequal power distribution can be provided by proper design of two identical feeder networks within the antenna.

Figure 8B:
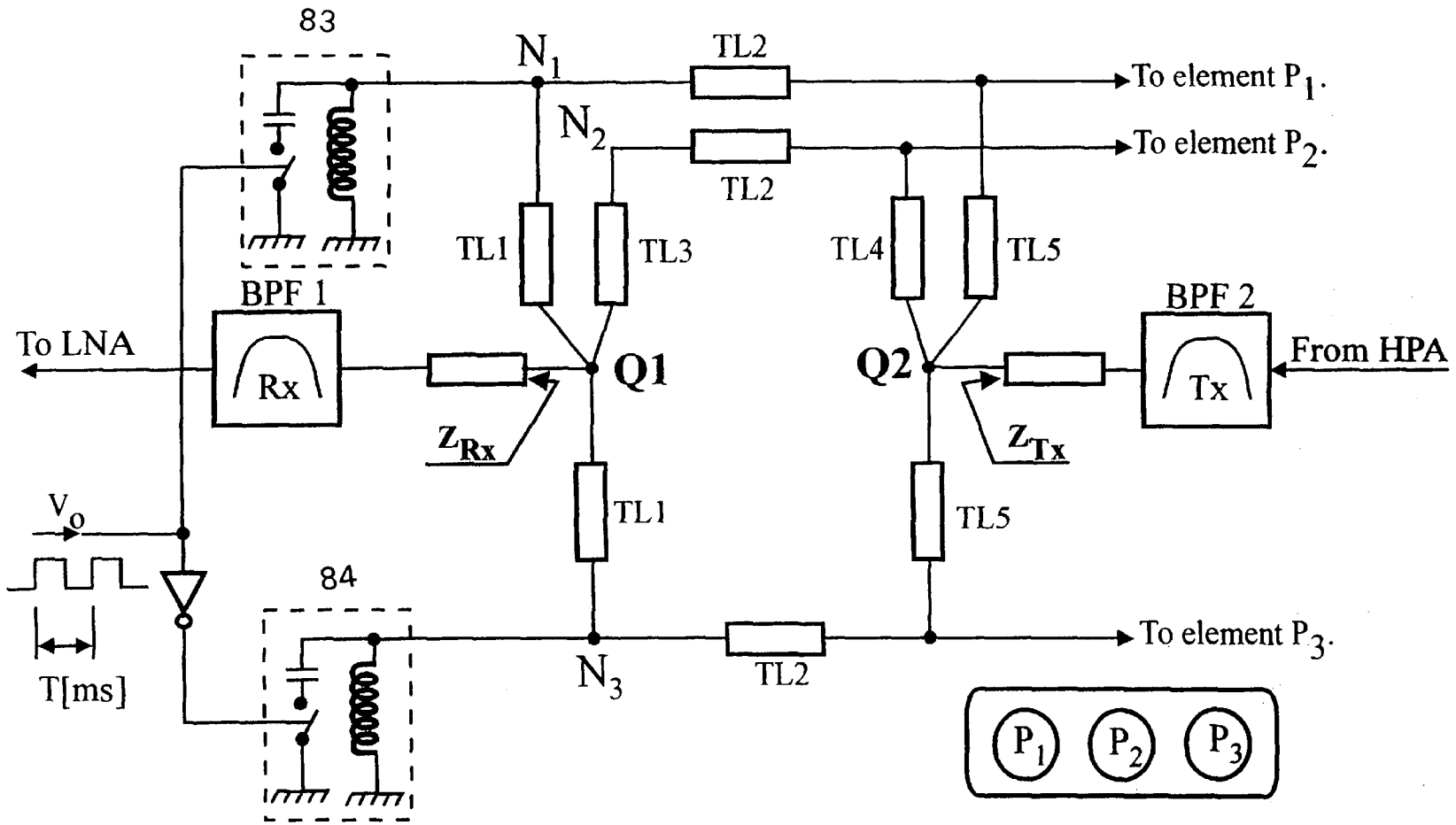

FIG. 8*b* shows an embodiment of a 3 channel duplexer/phase shifter circuitry designed to operate in conjunction with a 3 element linear array. The three Rx-signals from patch elements P1, P2 and P3 are combined in node Q1 in such a way that the phase of the signal from P2 is mainly constant whereas the phase of the signals from P1 and P2 are shifted substantially equally but with opposite sign by the phase shifters 1 and 2 (83 and 84), respectively. Amplitude tapering may also be used so that P2 may be fed at a higher power level than P1 and P3, but the power distribution is achieved by proper selection of the characteristic impedances of TL1, TL3, TL4 and TL5 bearing in mind that at Rx-frequencies, the generator impedance to BPF 1 shall be around 50 ohm and that the load impedance to BPF 2 at Tx-frequencies shall be around 50 ohm. As an example the characteristic impedances shown in parenthesis will enable P2 to be fed at a 1.44 dB higher level than P1 and P3.

The system of FIG. 8*b* has the following characteristics:
TL1, TL2, TL3: electric length=90° at center of Tx band.
TL4, TL5: electric length=90° at center of Rx band.
TL1: $Z_0$=92 Ω.
TL2: $Z_0$=50 Ω.
TL3: $Z_0$=78 Ω.
TL4: $Z_0$=78 Ω.
TL5: $Z_0$=92 Ω.

In addition, in FIG. 8*b*, a front view of a 3 element linear array antenna is illustrated.

FIGS. 9 and 10 show alternative configurations of 2 channel duplexer/phase shifter circuitry for beam switch in one plane.

The principles illustrated in FIGS. 8*a*, 8*b*, 9 and 10 for beam switch in one plane can be further extended to beam switch in two planes.

The function of the circuitry of FIG. 9 correspond to that of FIG. 8*a*, but in FIG. 9 two substantially identical circulators are used with the result that transmission lines TL5 can have any length and that the system bandwidth is increased.

The system of FIG. 9 has the following characteristics:
TL1: electric length=90° at center of Tx band.
TL1: electric length=90° at center of Rx band.
TL5: electric length any.
TL1: $Z_0$=71 Ω.
TL2: $Z_0$=71 Ω.
TL3: $Z_0$=50 Ω.
TL4: $Z_0$=50 Ω.
TL5: $Z_0$=50 Ω.

In FIG. 9, output A is to a single patch element or a group of patch elements, e.g. $P_1$+$P_2$, and output B is to a single patch element or a group of patch elements, e.g. $P_3$+$P_4$.

In FIG. 9, phase shifter 1 is denoted 91 and phase shifter 2 is denoted 92.

The function of the circuitry of FIG. 10 also correspond to that of FIG. 8*a*, but in FIG. 10 two substantially identical notch filters are used. They pass Rx-signals and reject or attenuate Tx-signals. One very important advantage of this notch filter system is that rejection requirements for BPF 1 are relaxed. If for example the notch filters have a 20 dB rejection or attenuation of Tx-signals the rejection requirements for BPF 1 are reduced by 20 dB.

The system of FIG. 10 has the following characteristics:
TL1: electric length=90° at center of Tx band.
TL2: electric length=90° at center of Rx band.
TL5: electric length=any.
TL1: $Z_0$=71 Ω.
TL2: $Z_0$=71 Ω.
TL3: $Z_0$=50 Ω.
TL4: $Z_0$=50 Ω.

In FIG. 10, output A is to a single patch element or a group of patch elements, e.g. $P_1+P_2$, and output B is to a single patch element or a group of patch elements, e.g. $P_3+P_4$.

In FIG. 10, phase shifter 1 is denoted 101 and phase shifter 2 is denoted 102.

An example of a microstrip notch filter is shown in FIG. 11 where W=width of microstrip [mm] and C=length of microstrip [mm]. In this figure, the boardsubstrate is Rogers, RO3003, 60 mil.

The examples shown in FIGS. 6 and 8–10 serve the purpose to illustrate that the basic principles in the duplexer/phase shifter configuration can be used in conjunction with any number of patch elements with any amplitude tapering, provided the susceptance imbalance in node Q1 caused by one phase shifter is always set to approximately nil by another phase shifter so that the generator impedance to BPF 1 is maintained at 50 ohm at Rx-frequencies.

Beamswitch:

FIG. 12 shows a radiation pattern (relative antenna gain for a 4 element patch antenna) for the antenna shown in FIG. 4, where the antenna is in the XY plane while gain is measured as a function of θ in the XZ plane, and when the antenna is operating together with a duplexer/phase shifter circuitry, e.g. the system shown in FIG. 6 where port P1 and patch P1, port P2 and patch P2, port P3 and patch P3 and port P4 and patch P4 are connected via respective 50 ohm transmission lines. The resulting radiation pattern measured on a transmit frequency is shown as the curve marked Tx. Since Tx-signals to P1, P2, P3 and P4 are not shifted in phase the maximum antenna gain occur for theta=0°.

For Rx-frequencies however, the radiation pattern is shifted as described by the two curves Rx1 and Rx2 within a period T as shown in FIG. 7, so that for a period of ½T the pattern is Rx1 and Rx2 for the other ½T. Therefore, within a period of T a full scan in the ZX plane is performed, see FIG. 7. Having completed a ZX scan the next scan may be a scan in the ZX plane or a scan in the ZY plane and having completed a ZY scan the next scan may be a ZY scan or a ZX scan.

A similar radiation pattern as that shown in FIG. 12 for the ZX plane will be obtained in the ZY plane when a ZY scan is performed.

System Block Diagram:

FIG. 13 shows a block diagram of the entire EME system illustrated in FIG. 1. It has a 4 element planar array (one of several possible configurations) antenna 1301 as described above in connection with FIG. 4 with 4 patch elements or 4 groups of elements, a 4 channel duplexer system 1302 including a duplexer/phase shifter circuitry as described in connection with FIG. 6 with one port, port P1, port P2, port P3 and port P4, for each of the antenna elements or group of elements, P1, P2, P3 or P4, respectively.

Signals to and from the internal mount equipment IME are routed in a single coaxial cable which in the EME (and IME) is connected to a triplexer 1306. In the embodiment shown in FIG. 13 the function of the triplexer is to separate the following signals: A transmit signal routed to the high power amplifier HPA 1304, a receiving signal being output from the low noise amplifier LNA 1303, an IF signal (Intermediate Frequency e.g. 21.4 MHz) from the IME to an AM-modem 1305 (amplitude modulator/demodulator) and finally to separate the supply voltage (DC voltage). The result is that interference between these signals is reduced or avoided.

The AM-modem 1305 has an amplitude detector (AM detector) which continuously may deliver information concerning the level of the IF signal to a pointing error detector 1307 with integrate and dump filtering. In the example in FIG. 13, there may be four main components which can contribute to amplitude modulation of the receiving signal being output from the LNA amplifier and hence amplitude modulation of the IF-signal, namely:

a) noise due to a very low carrier to noise ratio C/N0 in the receiving system when receiving signals from the satellite,
b) PM (phase modulation) to AM (amplitude modulation) conversion due to filtering of the spectrum of the receiving signal which by nature may be a PM (phase modulated) signal,
c) antenna pointing error which will result in an AM modulation frequency of 1/T (see the above discussion in connection with FIG. 7) and harmonics and subharmonics thereof, and
d) control signals from the IME to the EME being transported as amplitude modulation on the IF-signal. The frequency of this modulation should be so high that interference with the modulation frequencies mentioned in c) is avoided.

The amplitude modulation on the IF-signal mentioned in a), b) and c) will also be found on the output from the LNA. The amplitude modulation mentioned in d) will be found on the IF-signal only, since control signals are modulated onto this signal in the IME.

When control signals are transported from the IME to the EME the demodulated signalling signal from 1305 is input to the micro controller 1310, whereas in the case of signalling from the EME to the IME, the micro controller 1310 is the input source to the AM-modem 1305 which will amplitude modulate the IF-signal.

Many other ways of transporting control signals between the IME and the EME exist. For example two modems using low frequency carrier frequencies could be used, however, with the result that complexity and cost are increased. Since a 21.4 MHz IF-signal frequency may be used for transporting the amplitude modulation mentioned in c), the IF-signal may just as well be used for control signalling.

Two signals V0 (square wave signal) and V1 (ZY/ZX select) as shown in FIG. 7 may in an embodiment of the invention be generated by the micro controller 1310 and input to the duplexer system 1302 and the pointing error detector 1307. By utilizing an integrate and dump technic controlled by these signals it is possible to control up to two axis motors via motor control circuits 1308 (elevation motor control circuit) and 1309 (azimuth motor control circuit), which motor control circuits for the example as shown in FIG. 13 control an elevation motor 1320 and an azimuth motor 1322, respectively.

An angle βe (angular turn) between the antenna plane and platform 104, see FIG. 1, is monitored by the micro controller 1310. Monitoring may also be performed on the elevation motor axis as shown in FIG. 1. When βe exceeds about 180° the direction of rotation of the azimuth motor is changed via a DIR signal input to the azimuth motor control 1309. This is equivalent to about 180° change of phase in the feedback loop composed by the circuitry that generates a voltage proportional to the pointing error (i.e. output from 1307) and the azimuth motor plus motor control 1309.

FIG. 14 shows a block diagram of a system corresponding to the embodiment shown in FIG. 2. The system of FIG. 14 comprises a four element linear array antenna 1401, a 2 channel duplexer/phase shifter system 1402, a LNA circuit 1403, a HPA circuit 1404, an AM-modem 1405, a triplexer circuit 1406, a pointing error detector 1407 with integrate and dump filtering, an elevation motor control circuit 1408, an azimuthmotor control circuit 1409, a micro controller 1410, an elevation motor 1420 and an azimuth motor 1422. The system of FIG. 14 corresponds in many ways to the block diagram shown in FIG. 13, the main difference being that for the system of FIG. 14 the beamswitch is performed in only one plane, the ZX plane, as shown in FIG. 5. The result is that only one motor, the azimuth motor, is controlled by the pointing error measured during the beamswitch action.

The elevation motor is controlled by the micro controller 1410 based on amplitude information from the modem 1405. The micro controller is programmed to average the level of information from 1405 over a relatively long period of time and very slowly rotate the elevation motor till a signal maximum is achieved. The duplexer system in FIG. 14 is the duplexer/phase shifter circuitry illustrated in FIG. 8*a*, which has only two antenna output ports, A and B, and which only requires one input V0 (square wave signal) from the micro controller 1410. Provided that antenna gain and losses in the antenna feeder system and duplexer system are substantially the same as for the system of FIG. 13, the LNA, HPA and triplexer circuits are similar to the circuits of FIG. 13.

FIG. 15 shows a block diagram of a system corresponding to the embodiment shown in FIG. 3. The system of FIG. 15 comprises a 4 element planar array (one of several possible configurations) antenna 1501, a 4 channel duplexer/phase shifter system 1502, a LNA circuit 1503, a HPA circuit 1504, an AM-modem 1505, a triplexer circuit 1506, a pointing error detector 1507 with integrate and dump filtering, an elevation motor control circuit 1508, a cross-elevation motor control circuit 1509, a micro controller 1510, an azimuth motor control circuit 1511, an elevation motor 1520, a cross-elevation motor 1522 and an azimuth motor 1524. The system of FIG. 15 corresponds in many ways to the system of FIG. 13, the main difference being that the two axis motor feedback loops based on the outputs from the pointing error detector 1507 and therefore the beamswitching do not control the elevation and azimuth motors 1520 and 1524, but elevation and cross-elevation motors 1520 and 1522 with the azimuth motor 1524 being controlled by the micro controller 1510. The duplexer system is the duplexer/phase shifting circuitry shown in FIG. 6, and the antenna is as shown in FIG. 4 i.e. with four patches or four groups of patch elements.

An angle βe (angular turn) between the cross-elevation axis 311 and the platform 304 is shown in FIG. 3*b* (the cross-elevation axis is extended with a dotted line). βe and the angular rotation βc of the cross-elevation motor are monitored by the micro controller 1510. When βc exceeds a certain limit set by the mechanical construction, the azimuth motor is controlled so as to rotate in a selected direction at a well defined rate of speed until βc no longer exceeds the limit.

The value of βe determines the direction of rotation of the azimuth motor as illustrated below:

if βe is less than 180° and βc is greater than βc max.: then azimuth motor rotates right.

if βe is less than 180° and βc is smaller than βc min.: then azimuth motor rotates left.

if βe is greater than 180° and βc is greater than βc max.: then azimuth motor rotates left.

if βe is higher than 180° and βc is smaller than βc min.: then azimuth motor rotates right.

Depending of the nature of the mechanical gear to the azimuth axis the rotation direction right may be changed to rotation direction left and vice versa in the above.

Pointing Error Detector:

FIG. 16 shows a functional block diagram of a version of a pointing error detector which may be used in the systems of FIG. 13 and FIG. 15, i.e. a version with two independent output signals each of which is input to a motor control circuit. The outputs are in the form of low pass-filtered voltages (low pass filters 1611 and 1612) which are almost proportional to the pointing error of the antenna. One output represents the pointing error in the zx-plane while the other output represents the pointing error in the ZY-plane. The outputs are fed to motor control circuits each of which are designed to control the speed of a step motor or a DC-motor. Output A is to motor control circuit (e.g. elevation) and output B is to motor control circuit (e.g. azimuth as FIG. 13 or cross-elevation as in FIG. 15).

Three signals are input to the pointing error detector with one signal being signal V2 from the AM-modem which signal may represent the amplitude of e.g. the 21.4 MHz IF signal sent from the IME. The other two input signals being signal V0 and signal V1 coming from the micro controller (see FIG. 7). V0 is preferably a square wave signal with a time period T, i.e. the frequency 1/T Hz. is used for controlling a switch 1613 arranged at the input of an integrate and dump circuit 1606. V0 also trigger a monostable (Δt1—positive edgetriggered) 1609 at the positive going edge. Amplifiers 1602 (X(A)) and 1603 (X (−A)).are having the same numerical gain but having a substantially 180° difference in phase. During a scan in one of the planes ZX or ZY the amplifier 1602 should be coupled to the integrate and dump circuit 1606 for a period of time equal to ½T while the amplifier 1603 is coupled to the circuit 1606 for the remaining ½T period of time. During the period T the integrating part of the circuit 1606 will perform an integration and reach a final value hereafter called Vint at the end of T, which value Vint is sampled into one of two sample and hold circuits 1607 or 1608 depending on the position of a switch 1614. The sample and hold action is performed as a result of a pulse having a duration Δt1 being output from the monostable 1609, which pulse in turn trigger another monostable (Δt2—negative edgetriggered) 1610 resulting in a pulse of duration of Δt2. This pulse is used to dump Vint which correspond to resetting the integrator to a substantially zero output. The dump action of the circuit 1606 is initiated almost immediately after the elapse of the sample and hold action of circuits 1607 or 1608. Two delay circuits 1604 and 1605 having a delay of Δt=Δt1+Δt2 are used to avoid switching of switches 1613 or 1614 to take place before the sample and hold action of circuits 1607 or 1608 and the dump action of the circuit 1606.

The signal V1 is used for controlling the switch 1614 and for selection of the plane ZX or ZY in which the scan is performed, see FIG. 13 or FIG. 15. When a scan is performed in e.g. the ZX plane, the result of the scan, Vint, is routed to the appropriate motor control circuit which controls direction of reception of maximum signal in that plane by applying an angular rotation of the antenna via the axis motor.

The signal V2 from the AM-modem is highpass-filtered in a highpass filter circuit 1601, the 3 dB frequency of which is approximately 0.2×1/T. Output signal V3 from circuit 1601 is input to the two amplifiers 1602 and 1603. If the antenna pointing error is about zero, the signal V3, although still very noisy, will be almost constant during a scan period T which results in Vint being substantially zero. However, if a pointing error exists, the signal V3 will have different values in the first and second half of the period T which in turn will generate a value of Vint different from zero.

If a pointing error exists, then signal V3, the highpass filtered output of signal V2 from the AM-modem, will have the form of a noisy square wave signal with the frequency of 1/T Hz when beamswitch is performed in one plane, ZX or ZY, and the form of a combination of square wave signals with the frequency of ½T when beamswitch is performed in two planes, ZX and ZY. The amplitude of the square wave of signal V3 will be almost proportional to the pointing error. However, signal V3 will be strongly impaired by noise due to the very low signal level received from the satellite. In order to obtain a high signal to noise ratio and thereby achieve the best possible information for the motor control systems, an optimum filtering or matched filtering of signal V3 is required. Such a filtering is performed by the integrate and dump technic via circuit 1606.

In FIG. 16, $\Delta t \approx 0.005 \cdot T$.

FIG. 17 shows a functional block diagram of an embodiment of a pointing error detector which may be used in the system of FIG. 14. The detector of FIG. 17 comprises a highpass filter 1701, two amplifier circuits 1702 (X(A)) and 1703 (X(−A)), a delay circuit 1704 (delay $\Delta t = \Delta t1 + \Delta t2$), a switch 1705, an integrate and dump circuit 1706, a sample and hold circuit 1707, a lowpass filter 1708, a monostable 1709 (Δt1—positive edgetrigged) and a monostable 1710 (Δt2—negative edgetriggered). The detector of FIG. 17 operates in a manner corresponding to the detector of FIG. 16, with the exception that beamswitch is only performed in one plane and hence only one motor is controlled by the output A to a motor control circuit.

The Receiver System (High Frequency Part):

The satellite signal used for the antenna stabilisation/satellite tracking function should be rather constant or uninterrupted. Since this is not always the case for the signal on a traffic channel, the receiver usually must have the possibility to be tuned simultaneously to two frequencies or two channels, one of which is the frequency of a traffic channel, voice, fax, data, etc., the other being the frequency of a constant carrier or modulated carrier transmitted from the satellite. These channels are hereafter designated channel 1 and channel 2, respectively. A receiver system for receiving these two channels should therefore preferably comprise two receivers, which in the following are named REC 1 (for receiving channel 1) and REC 2 (for receiving channel 2), respectively.

In an embodiment of the present invention REC1 and REC2 are composed of electronic parts in the EME and electronic parts in the IME. REC1 and REC2 share the electronic parts in the EME which parts comprise: antenna, such as 1301, 1401 or 1501; duplexer/phase shifter system, such as 1302, 1402 or 1502; low noise amplifier LNA, such as 1303, 1403 or 1503; and triplexer, such as 1306, 1406 or 1506.

The remaining parts of REC1 and REC2 are built into the IME as shown in FIG. 18, which show an example (block diagram) of an embodiment of a dual channel receiver implemented in the IME. Only the high frequency parts (RF circuitry) are shown in FIG. 18, whereas low frequency parts such as baseband circuits, CPU, power supply etc. are not shown. REC1 and REC2 share as much of the electronic parts as possible in FIG. 18, in this case a triplexer 1801, a mixer 1802 and a reference-oscillator 1806 (5.7 MHz).

The following circuits are entirely related to REC1: 1804 (tracking filter 1+amplifier), 1810 (110.8→144.8 MHz PLL, Δf=100 kHz), 1811 (mixer+45 MHz filter+amplifier), 1813 (23.6±0.05 MHz PLL, Δf=1.25 kHz), 1815 (mixer), 1816 (filter 21.4 MHz±10 kHz), and 1818 (amplifier), and the following circuits are entirely related to REC2: 1803 (tracking filter 2+amplifier), 1807 (110.8→144.8 MHz PLL Δf=100 kHz), 1808 (23.6±0.05 MHz PLL, Δf=1.25 kHz), 1809 (mixer+45 MHz filter+amplifier), 1812 (mixer), 1814 (filter 21.4 MHz±2 kHz), 1817 (amplifier) and 1819 (am-modem).

Both REC1 and REC2 uses a tripple down conversion and outputs a 21.4 MHz IF-signal. As an example the frequency band of local oscillators 1807, 1808, 1810 and 1813 enable REC1 and REC2 to cover the receiving frequency band 1525–1559 MHz. It should be noticed that the 21.4 MHz IF-signal from REC2 in the embodiment shown in FIG. 18 is sent to the EME via triplexer 1801 and used in the EME for the antenna stabilization/satellite tracking.

In FIG. 18, circuit 1805 is a 1459.2 MHz PLL, 1820 is a filter, and 1821 is a mixer+amplifier. Input A is a Tx-IF (voice, data, fax) 167→210.3 MHz, input B is control signalling to EME, output C is control signalling from EME, and output D is a traffic channel, 21.4 MHz (voice, data, fax).

It is common praxis within the field of receiver design to have the filter bandwidth in the down converter chain reduced as the signal level increases. As an example for REC1 the bandwidth of circuit 1804 is smaller than the bandwidth of BPF1 in FIG. 8, and the bandwidth of circuit 1811 is smaller than the bandwidth of circuit 1804. Finally, the bandwidth of circuit 1816 is smaller than the bandwidth of circuit 1811. The same principles are used for REC2.

There are several other possible ways of arranging REC1 and REC2. For example all of REC2 could be built into the EME with its own reference oscillator and local oscillator system. This would imply that no IF signal will have to be transported from IME to EME. On the other hand a more complex system for communicating between the two units must be established.

It shall be emphasized that when there is no control signal communication between the IME and the EME the amplitude modulated signal from amplifier 1817 passes through the AM-modem 1819 just as if the modem 1819 was an amplifier with a unity gain. When control signalling or signal communication takes place between the two units IME and EME, the tracking system will be exposed to a small disturbance. However, in the preferred embodiment control signal communication between the two units is not be very frequent and will have only a short duration in order to minimize disturbances.

The Transmit System (High Frequency Part):

In an embodiment of the present invention the transmit system is divided into one part being built into the EME and another part being built into the IME. These two parts are interconnected via a coaxcable carrying all signals between the EME and the IME. As an example, the following transmitting circuits are built into the EME: antenna, such as 1301, 1401 or 1501; duplexer system, such as 1302, 1402 or 1502; high power amplifier HPA, such as 1304, 1404 or 1504; and triplexer, such as 1306, 1406 or 1506. As an example, the following transmitting circuits are built into the IME: triplexer 1801 and up-converter consisting of mixer plus amplifier 1821 and filter 1820. The transmitting intermediate frequency TX-IF as shown in FIG. 18 can be generated in numerous ways which are known within the art. The TX-IF circuitry and modulator are therefore not shown.

In the above-described embodiments of receiver and transmitting systems, only the high frequency parts of the systems have been dealt with. However, corresponding low frequency parts of such systems are well-known within this field of technology.

EME with Enhanced Software Realisation:

Although the micro controller such as 1310, 1410 or 1510, see FIGS. 13, 14 and 15, is only designed to solve a minor part of the tasks to be performed in the tracking system, it would be naturally to adapt or programme the micro controller to perform several other tasks to be performed, such as the function of the pointing error detector such as 1307, 1407 or 1507. Simultaneously, the micro controller should also be able to perform the function of the AM-modem. If the micro controller has sufficient DSP (Digital Signal Processing) capacity it may even be able to perform the filter function of filter 1814 in FIG. 18, thereby enabling the feature of adaptively adjusting filter bandwith and shape to the actual received signal spectrum in REC2.

Thus, it should be understood that several embodiments for performing the principles of the present invention may be obtained. However, whether these embodiments are using digital or analog solutions or an combination thereof, such embodiments would be within the scope of the invention.

What is claimed is:

1. A method for two way communication between a first station and a second station each said station including a receiving device and a transmitting device for receiving and transmitting electromagnetic communication signals, the first station having an array antenna for transmitting and receiving the electromagnetic communication signals to and from the second station, the array antenna having a direction of optimum transmission or direction of electric boresight of transmission being substantially constant in relation to a physical boresight axis of the antenna or an axis perpendicular to a plane mainly including said array antenna, and said array antenna being coupled to the receiving device and transmitting device of the first station by an electrical feeding device, whereby one or more signals are transmitted from the first station to the second station, and the direction of the physical boresight axis of the antenna of the first station is controlled, said method comprising electrically changing or switching a direction of improved reception or electric boresight of reception of the antenna of the first station in one or more directions displaced from the direction of the physical boresight axis by changing electric characteristics of said feeding device, monitoring, during said switching of the direction of improved reception or electric boresight of reception, one or more signals carrying information representing variations in receiving signal strength of one or more signals transmitted from the second station and received by the first station during said switching, and mechanically moving the antenna in response to the results of said monitoring of the signal strength information signal(s) thereby changing the direction of the physical boresight axis so as to reduce or minimize pointing errors of the antenna in relation to the second station and increase or maximize the strength of signals received by the first station from the second station and/or vice versa.

2. A method according to claim 1, wherein the electric characteristics of the feeding device are changed so that the direction of improved reception or electrical boresight of the reception is changed for any receiving signals having a frequency within an allocated receiving frequency band.

3. A method according to claim 1, wherein radiated transmit signal(s) have a frequency within an allocated transmit frequency band and are unaffected by the said switching on receive frequencies in the sense that there is no or very little beam switch loss.

4. A method according to claim 1, wherein said electrically switching is performed so that the frequency spectrum of a signal transmitted from the antenna of the first station mainly along the direction of optimum transmission or direction of electric boresight of transmission is substantially unaffected by said switching.

5. A method according to claim 1, wherein said electrically switching is performed so that substantially no phase and/or amplitude distortion is imposed on signals transmitted from the first station mainly along the direction of optimum transmission or direction of electric boresight of transmission.

6. A method according to claim 1, said method further comprising at least partly attenuating signals within the transmit frequency range by receiving frequency filtering means coupled to the receiving means of the first station, and at least partly attenuating signals within the receiving frequency range by transmit frequency filtering device coupled to the transmitting means of the first station, said receiving frequency filtering device having a frequency characteristic different from the frequency characteristic of the transmit frequency filtering device, so that the receiving device and the transmitting device of said first station can operate in conjunction with the antenna substantially simultaneously but at different frequencies.

7. A method according to claim 6, wherein the receiving frequency filtering device has a characteristic allowing frequencies in the range of 1525–1559 MHz to be passed without any substantial attenuation, and/or the transmit frequency filtering device has a characteristic allowing frequencies in the range of 1626.5–1660.5 MHz to be passed without any substantial attenuation.

8. A method according to claim 6, wherein the receiving and transmit frequency filtering device is part of the feeding device, and receiving and transmit frequency filtering device preferably represents a characteristic impedance substantially around 50 ohm within the frequency range of the received signals and the frequency range of the signals to be transmitted, respectively.

9. A method according to claim 6, wherein said receiving filtering device has at least 40 dB, preferably at least 60 or 65 dB, attenuation of signals within the transmit signal frequency range, and/or said transmit filtering device has at least 40 dB, preferably at least 60 or 65 dB, attenuation of signals within the receiving signal frequency range.

10. A method according to claim 1, wherein said second station is a satellite.

11. A method according to claim 1, wherein said electromagnetic communication signals are radio signals.

12. A method according to claim 1, wherein the antenna includes at least two array elements such as two patch elements, and said changing of electric characteristics of the feeding device comprises shifting, by use of a phase shifter being part of said feeding device, the phase of signals received from the array elements.

13. A method according to claim 12, wherein said phase shifting device and said feeding device are designed so that substantially no current or only a relatively low current is caused in the phase shifter by transmit signals so that loss of transmit power in phase shifters is reduced.

14. A method according to claim 10, wherein the feeding device comprises a notch filter device for attenuating signals mainly within the frequency range of the transmit signals thereby reducing attenuation requirements of the receiving frequency filtering device with respect to the transmit signal frequency range by at least 15 dB, preferably at least 20 dB.

15. A method according to claim 12, wherein the phase shifting is performed so that when combining said phase shifted signals the effects of said phase shifting have substantially no or only a relatively small effect on the generator impedance of the combined signal with the effect that LNA (low noise amplifier) noise figure and gain is kept constant and thus independent of phase shifting.

16. A method according to claim 12, wherein said phase shifting comprises shifting with a predetermined phase.

17. A method according to claim 12, wherein the antenna comprises a linear array of elements allowing said electrically changing of the direction of optimum reception to be performed within a first plane.

18. A method according to claim 12, wherein the antenna comprises a planar array of elements having at least four array elements allowing said electrically changing of the direction of optimum reception to be performed within a first plane and/or a second plane which may be substantially perpendicular to the first plane.

19. A method according to claim 18, wherein said electrically changing of the direction of optimum reception is performed within said first plane and said second plane with more changes being performed within the first plane than the second plane during a predetermined period of time.

20. A method according to claim 18, wherein said electrically changing or switching of the direction of improved reception is performed so that at least two directions of improved reception are obtained within each plane of switching.

21. A method according to claim 20, wherein the obtained directions of optimum reception within each plane are separated a few degrees, for example 15°.

22. A method according to claim 15, wherein the direction of the physical boresight axis of the antenna is controlled on basis of variations in strength of the combined receiving signals.

23. A method according to claim 12, wherein the phase shifting is performed periodically with a frequency which preferably may be in the range of 1 Hz–500 kHz, more preferably in the range of 50 Hz–150 Hz, and even more preferably around 100 Hz.

24. A method according to claim 12, wherein said phase shifted receiving signals are combined, said combined signal being an amplitude modulated signal caused by differences in amplitudes of received signals due to changes in the direction of improved reception caused by said phase shifting, and wherein a demodulated signal representing the amplitude differences comprised in the combined signal is being generated and used for said monitoring.

25. A method according to claim 24, wherein the monitoring of the demodulated signal comprises amplifying and filtering the demodulated signal during at least one period of phase shifting, said period of phase shifting causing the direction of optimum reception to be switched between at least two directions.

26. A method according to claim 25, wherein the sign of the amplification is substantially reversed in response to shifting of phases.

27. A method according to claim 25, wherein the demodulated signal is filtered or matched filtered by an integrate and dump technique so as to obtain an optimum signal to noise ratio for motor control servos.

28. A method according to claim 1, wherein the electrical feeding device is designed to operate mainly as a system having a 50 ohm characteristic impedance.

29. A system for communication between a first station and a second station each station including a receiving device and a transmitting device for transmitting and receiving electromagnetic communication signals, said first station further comprising an array antenna for transmitting and receiving said electromagnetic communication signals to and from said second station, said array antenna having a direction of optimum transmission or direction of electric boresight of transmission being substantially constant in relation to a physical boresight axis of the antenna or an axis perpendicular to a plan including said array antenna, an electrical feeding device for coupling said antenna to the receiving device and transmitting device of the first station, an electrical switch for changing or switching a direction of improved reception or electric boresight of reception of the antenna of the first station in one or more directions, displaced from the direction of the physical boresight axis by changing electric characteristics of said feeding device, a monitor, which monitors during said switching of the direction of improved reception or electric boresight of reception, one or more signals carrying information representing variations in receiving signal strength of one or more signals transmitted from the second station and received by the first station during said switching, and a moving device for mechanically and/or angularly moving the antenna, and a controller for controlling the movement of said antenna in response to the results of said monitoring of the signal strength information signal(s) thereby changing the direction of the physical boresight axis so as to reduce or minimize pointing errors of the antenna in relation to the second station and increase or maximize the strength of signals received by the first station from the second station and/or vice versa.

30. A system according to claim 29, wherein said first station further comprises a transmit frequency filtering device coupled to said transmitting device of the first station for at least partly attenuating signals within the receiving signal frequency range, and a receiving frequency filtering device coupled to said receiving device of the first station for at least partly attenuating signals within the transmit signal frequency range, said receiving frequency filtering device having a frequency characteristic different from the frequency characteristic of the transmit frequency filtering device, so that the receiving device and the transmitting device of said first station can operate in conjunction with the antenna substantially simultaneously but at different frequencies.

31. A system according to claim 30, wherein the receiving frequency filtering device is adapted to allow frequencies in the range of 1525–1559 MHz to be passed without any substantial attenuation, and the transmit frequency filtering device is adapted to allow frequencies in the range of 1626.5–1660.5 MHz to be passed without any substantial attenuation.

32. A system according to claim 30, wherein the receiving and transmit frequency filtering device are part of the feeding device, said receiving and transmit frequency filtering device preferably representing a characteristic impedance substantially around 50 ohm within the frequency range of the received signals and the frequency range of the signals to be transmitted, respectively.

33. A system according to claim 30, wherein said receiving filtering device has at least 40 dB, preferably at least 60 or 65 dB, attenuation of signals within the transmit signal frequency range, and/or said transmit filtering device has at least 40 dB, preferably at least 60 or 65 dB, attenuation of signals within the receiving signal frequency range.

34. A system according to claim 29, wherein said electrical switch is adapted to change said electric characteristics so that characteristics of the feeding device comprises a phase shifting device adapted to shift the phase of signals received from the array element.

35. A system according to claim 29, said system being adapted to transmit signals having a frequency within an allocated transmit frequency band in such a way that beam switch loss is avoided even though beam switching is performed on receive frequencies.

36. A system according to claim 29, wherein said electrical switch for switching the direction of improved reception is adapted to perform said switching so that the frequency spectrum of a signal transmitted from the antenna of the first station mainly along the direction of optimum transmission or direction of electric boresight of transmission is substantially unaffected by said switching.

37. A system according to claim 29, wherein electrically switch for switching the direction of improved reception is adapted to perform said switching so that substantially no phase and/or amplitude distortion is imposed on signals transmitted from the first station mainly along the direction of optimum transmission or direction of electric boresight of transmission.

38. A system according to claim 29, wherein the antenna comprises at least two array elements such as two patch elements, and said electrical switch for changing the electric characteristic of the feeding device comprises a phase shifting device adapted to shift the phase of signals received from the array elements.

39. A system according to claim 38, wherein said phase shifting device and said feeding device are being designed so that substantially no current or only a relatively low current is caused in the phase shifting means by transmit signals.

40. A system according to claim 38, wherein the feeding device comprises a notch filtering device for attenuating signals mainly within the frequency range of the transmit signals thereby reducing attenuation requirements of the receiving frequency filtering device with respect to the transmit signal frequency range by at least 15 dB, preferably at least 20 dB.

41. A system according to claim 38, wherein the feeding device and the phase shifting device are designed so that when combining said phase shifted signals the effects of said phase shifting has substantially no or only a relatively small effect on the generator impedance of the combined signal.

42. A system according to claim 41, wherein said monitoring device is adapted to monitor the combined receiving signals, and the means for controlling the mechanical and angularly movement of the antenna is adapted to control the movement in response to variations in strength of the combined receiving signals.

43. A system according to claim 38, wherein said phase shifting device is adapted to shift the phase of a signal by a predetermined phase.

44. A system according to claim 38, wherein the antenna comprises a linear array of elements allowing electrically changing of the direction of improved reception within a first plane.

45. A system according to claim 38, wherein the antenna comprises a planar array of elements having at least four array elements allowing electrically changing of the direction of improved reception within a first plane and/or a second plane which may be substantially perpendicular to the first plane.

46. A system according to claim 45, wherein said electrical switch is adapted to control said changing of direction so that at least two directions of maximum gain are obtained within each plane of switching.

47. A system according to claim 46, wherein said means for electrically changing the direction of optimum reception is adapted to control said changing of direction so that the obtained directions of optimum reception within each plane are separated a few degrees, for example 15°.

48. A system according to claim 38, wherein said electrical switch is adapted to perform the phase shifting periodically with a frequency which preferably may be in the range of 1–500 Hz, more preferably in the range of 50–150 Hz, and even more preferably around 100 Hz.

49. A system according to claim 38, wherein said feeding device is adapted to produce a combined signal by combining receiving signals being output from said phase shifting device, said combined signal being an amplitude modulated signal caused by differences in amplitude of received signals due to changes in the direction of improved reception caused by said phase shifting, said system further comprising a demodulator adapted to generate a demodulated signal representing the amplitude differences of the combined signal, said demodulated signal being input to said monitor.

50. A system according to claim 49, wherein said monitor further comprises an amplifier and a filter for amplifying and filtering the demodulated signal during at least one period of phase shifting, said period of phase shifting causing the direction of improved reception to be switched between at least two directions.

51. A system according to claim 50, wherein said filter is adapted to perform a matched filtering by use of an integrate and dump technique.

52. A system according to claim 50, wherein said amplifier means is adapted to substantially reverse the sign of the amplification in response to shifting of phases.

53. A system according to claim 29, wherein the electrical feeding device is designed to operate mainly as a 50 ohm system.

54. A system according to claim 29, wherein said moving device for mechanically and/or angularly moving the antenna comprises at least one axis motor, preferably two or three axis motors.

55. A system according to claim 54, wherein at least one axis motor is adapted to move the antenna in response to one or more control signal(s) being output from said means for controlling the movement of the antenna as a result of said monitoring of the switching of electric boresight of reception.

56. A tracking system for tracking an electromagnetic energy source, said system having a first station with a receiver and transmitter for transmitting and receiving electromagnetic communication signals, said first station further comprising an array antenna for transmitting and receiving said electromagnetic communication signals to and from said energy source, said array antenna having a direction of optimum transmission or direction of electric boresight of transmission being substantially constant in relation to a physical boresight axis of the antenna or an axis perpendicular to a plane mainly including said array antenna, electrical feeding device for coupling said antenna to the receiver and transmitter of said first station, an electrical switch which changes a direction of improved reception or electric boresight of reception of said antenna of said first station in one or more directions displaced from the direction of the physical boresight axis by changing electric characteristics of said feeding device, a monitor for monitoring, during said switching of said direction of improved reception or electrical boresight of reception, one or more signals carrying information representing variations in receiving signal strength of one of more signals transmitted from the energy source and received by the first station during said switching, and a moving device adapted to mechanically and/or angularly move the antenna, and a controller adapted to control the movement of said antenna in response to the results of said monitoring of the signal strength information signal(s) thereby changing the direction of the physical boresight axis so as to reduce or minimize pointing errors of the antenna in relation to the electromagnetic energy source.

57. Electrical feeding device to be used in a tracking system for tracking an electromagnetic energy source, said tracking system having a first station with receiver and transmitter for transmitting and receiving electromagnetic communication signals, the first station further having an array antenna for transmitting and receiving said electromagnetic communication signals to and from said energy source, said array antenna having a direction of optimum transmission or direction of electric boresight of transmission being substantially constant in relation to a physical boresight axis of the antenna or an axis perpendicular to a plane mainly including said array antenna, and said array antenna being coupled to the receiver and transmitter of the first station by the electrical feeding device, said electrical feeding device comprising duplexer for coupling said antenna to the receiver and transmitter of the first station, and phase shifting device for electrically changing or switching a direction of improved reception or electric boresight of reception of the antenna of the first station in one or more directions displaced from the direction of the physical boresight axis.

58. Feeding means according to claim 57, wherein said duplexer means comprise transmit frequency filtering means coupled to said transmitting means of the first station for at least partly attenuating signals within the receiving signal frequency range, and receiving frequency filtering means coupled to said receiving means of the first station for at least partly. attenuating signals within the transmit signal frequency range, said receiving frequency filtering means having a frequency characteristic different to the frequency characteristic of the transmit frequency filtering means, so that the receiving means and the transmitting means of said first station can operate in conjunction with the antenna substantially simultaneously but at different frequencies.

59. Feeding device according to claim 57, wherein said phase shifting device is adapted to change the direction of improved reception or electrical boresight of reception for any receiving signals having a frequency within an allocated receiving frequency band.

60. Feeding device according to claim 57, wherein the duplexer is adapted to pass transmit signals within an allocated transmit frequency band from the transmitter to the antenna.

* * * * *